United States Patent [19]

Wendling et al.

[11] Patent Number: 4,963,106

[45] Date of Patent: Oct. 16, 1990

[54] ELECTRICAL CONNECTOR HOUSING ASSEMBLY

[75] Inventors: Hannes J. Wendling, Langen; Harald Bouda, Haibach, both of Fed. Rep. of Germany

[73] Assignee: AMP Incorporated, Harrisburg, Pa.

[21] Appl. No.: 456,408

[22] Filed: Dec. 26, 1989

[51] Int. Cl.[5] ..... H01R 13/422

[52] U.S. Cl. ..... 439/595

[58] Field of Search ..... 439/595–603, 439/744, 752, 271, 272

[56] References Cited

U.S. PATENT DOCUMENTS

| | | | |
|---|---|---|---|
| 4,386,816 | 6/1983 | Frear et al. | 439/744 |
| 4,565,416 | 4/1984 | Rudy et al. | 439/595 |
| 4,655,525 | 7/1985 | Hunt et al. | 439/599 |
| 4,698,030 | 10/1987 | Ryll et al. | 439/752 |
| 4,749,373 | 6/1988 | Brekosky et al. | 439/595 |
| 4,787,864 | 11/1988 | Hunt, III et al. | 439/595 |

FOREIGN PATENT DOCUMENTS

| | | |
|---|---|---|
| 3720751 | 6/1987 | Fed. Rep. of Germany . |
| 2584539 | 7/1986 | France . |

*Primary Examiner*—Neil Abrams

*Attorney, Agent, or Firm*—Bruce J. Wolstoncroft

[57] ABSTRACT

The assembly comprises an insulating housing having concentric arrays of terminal receiving cavities extending between a rear face and a front face of the housing. Terminal latching lances extends from an intermediate face of the housing between the front and rear faces. Each cavity is in the form of an open channel between the intermediate face and the front face. The channels of one array of cavities open towards the channels of the other array of cavities and vice versa. A terminal locking insulating insert is insertable into the housing to maintain the latching lances in locking engagement with terminals and to complete the channels so that each cavity is tubular throughout.

25 Claims, 31 Drawing Sheets

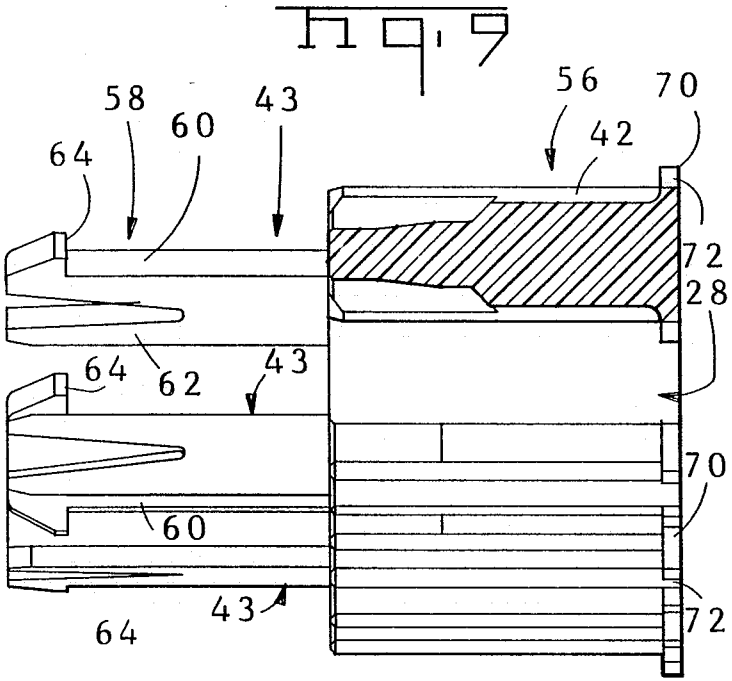
70
72
28
70
72
56
42
43
43
43
60
62
60
58
64
64
64
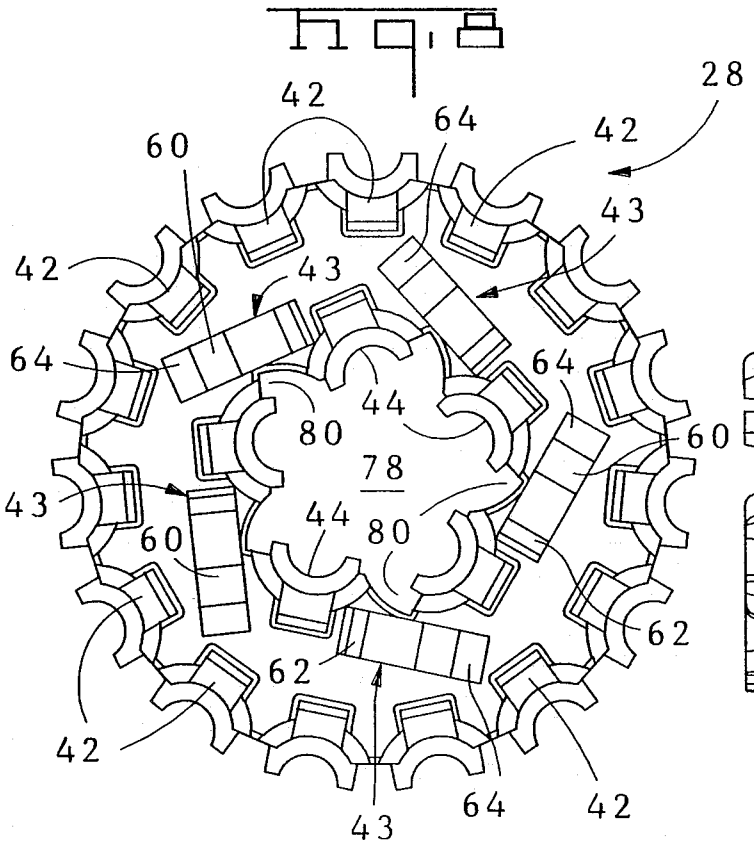
28
42
43
60
62
42
64
64
64
44
78
80
43
42
43
80
44
62
60
60
42
64
43
42

110
112
116a
116b
118
120x
120y
122
126
128
134
135
136
137
140
142
146
148
150
152
153

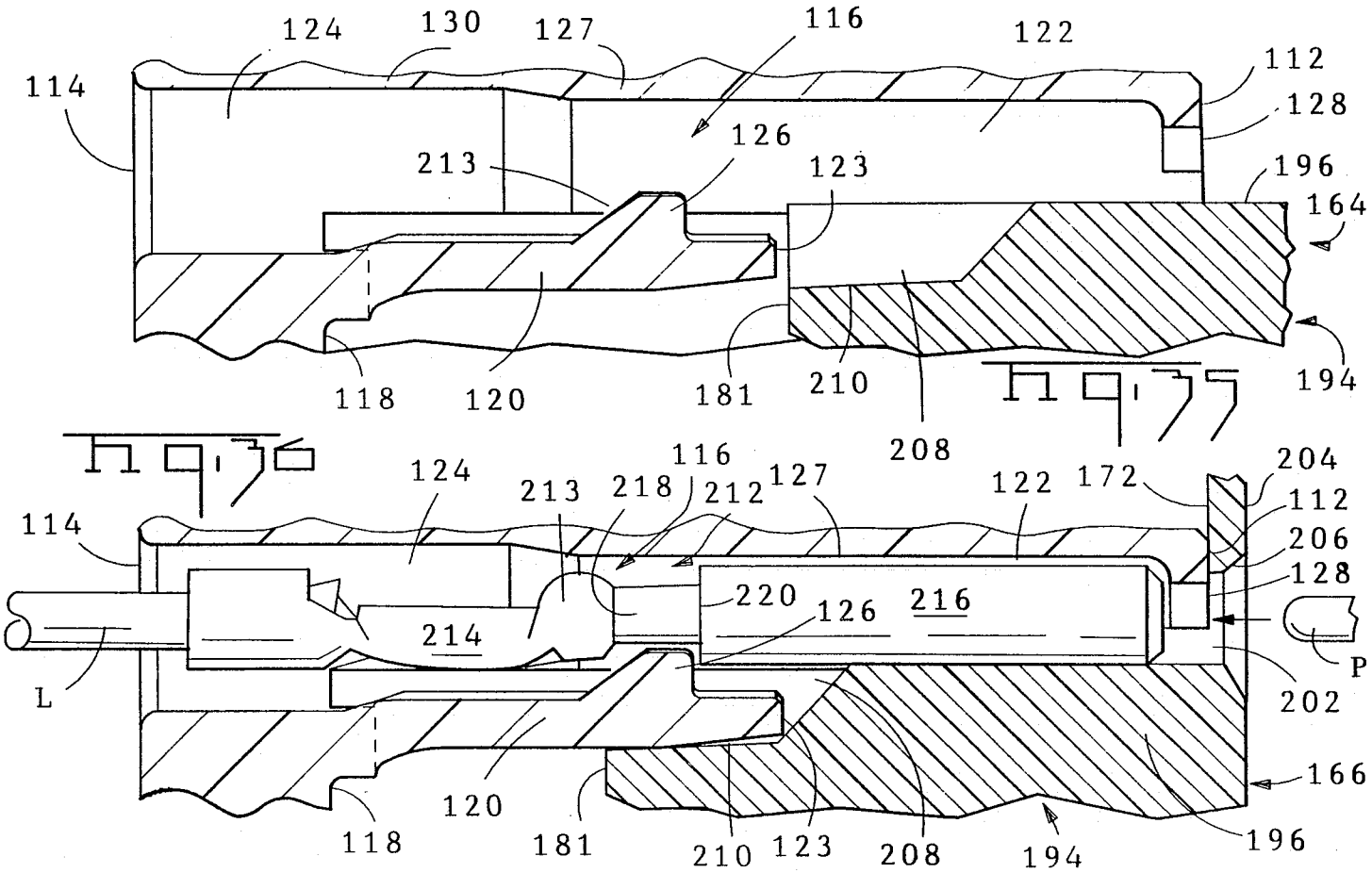
112
128
196
164
194
122
116
126
123
208
210
181
127
130
124
213
120
118
114
204
206
P
202
166
172
216
220
212
218
214
L

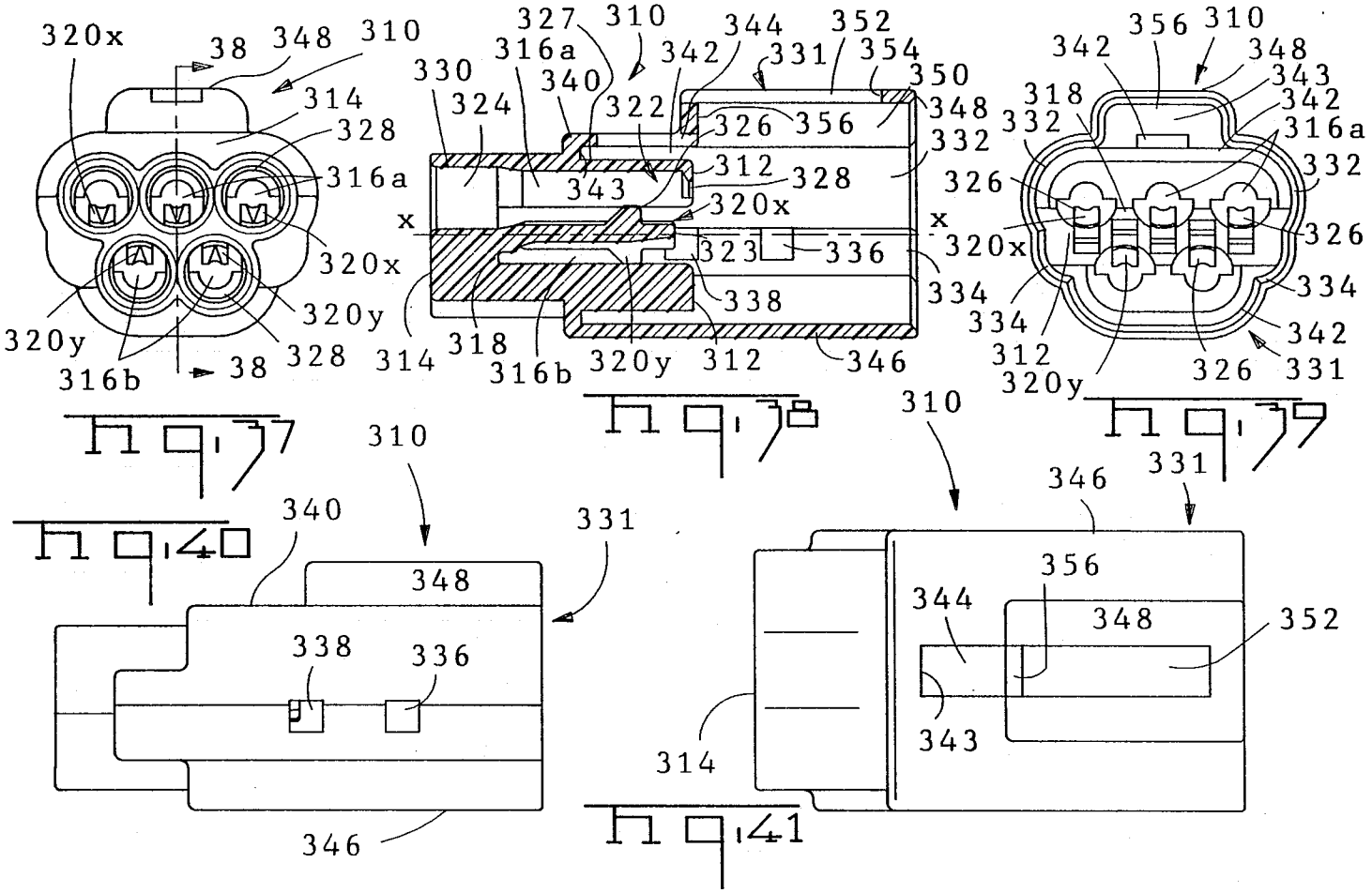
310
348
343
342
316a
332
326
334
342
331
356
342
318
332
326
320x
334
312
320y
331
352
346
356
348
344
343
310
314
350
348
332
326
x
334
354
352
331
356
328
336
346
344
326
312
320x
323
338
312
342
310
322
343
320y
327
316a
340
316b
324
318
330
x
314
310
348
336
338
340
346
310
314
328
316a
320x
320y
328
38
38
320x
316b
320y 358
360
362
364
366
367
368
370
371
372
374
376
378
380
382
384a
384b
386
388
390
392
43

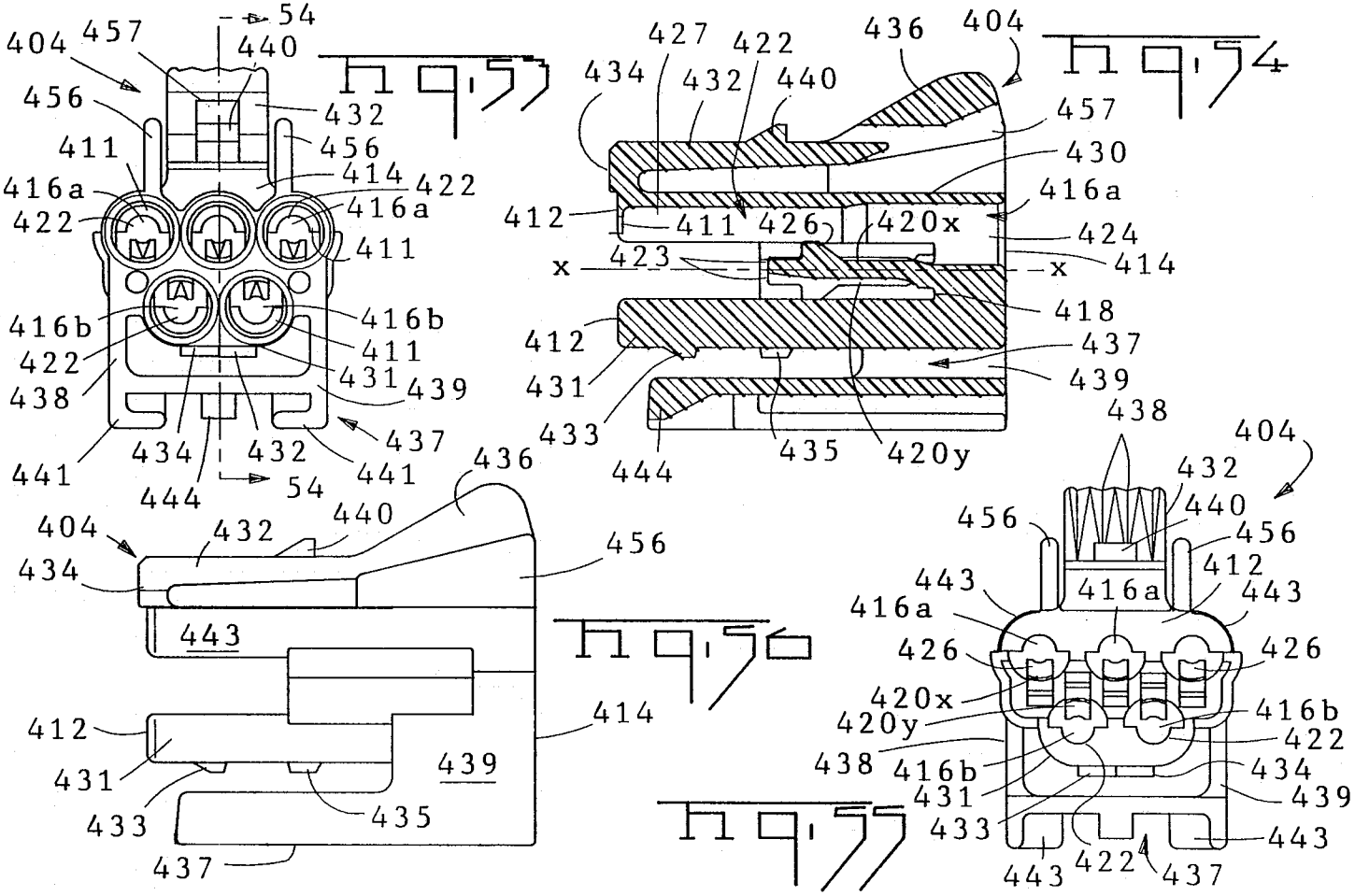
404
436
457
430
416a
424
414
x
418
437
439
438
420x
420y
426
411
423
422
440
432
427
434
412
431
433
435
444
456
443
416b
422
434
439
443
437
441
54

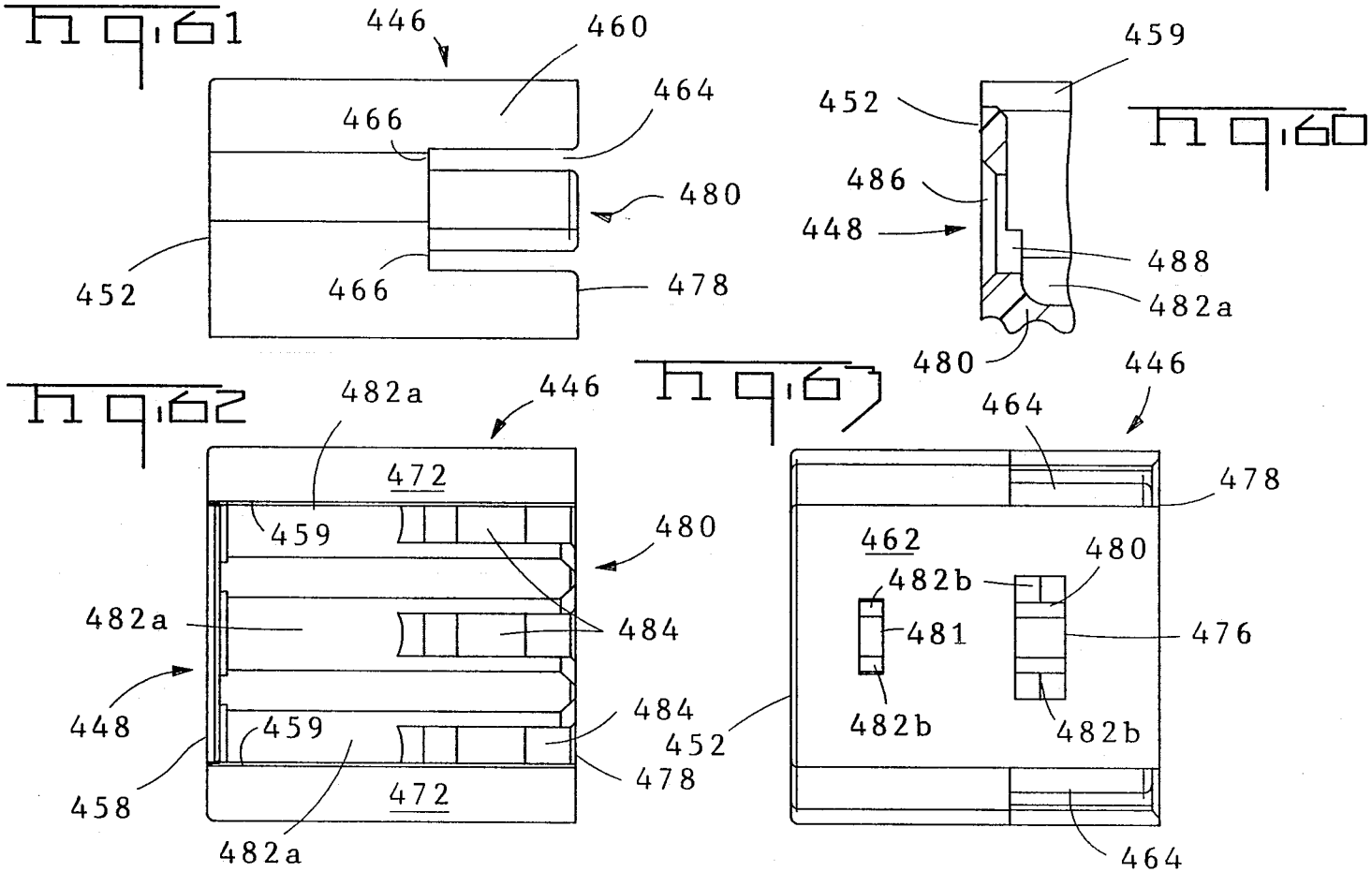
459
452
486
448
488
482a
480
446
464
478
476
480
482b
464
482b
481
462
482b
452
460
464
480
478
446
466
466
452
480
484
484
452
478
446
472
472
482a
459
459
482a
482a
448
458

ELECTRICAL CONNECTOR HOUSING ASSEMBLY

BACKGROUND OF THE INVENTION

1. Field of the Invention

This invention relates to an electrical connector housing assembly particularly, but not exclusively, for a circular cross section electrical connector.

2. Description of the Prior Art

There is disclosed in US-A-4,698,030, an electrical connector housing assembly comprising, an insulating housing having a terminal receiving rear face, a front face opposite thereto, a first array of terminal receiving first through cavities a second array of terminal receiving second through cavities spaced from those of the first array, each cavity opening into both of said front and rear faces, and a terminal locking, insulating insert for locking an electrical terminal in each cavity.

Terminals used with this known housing assembly, each comprise a latching lance formed integrally with the terminal, for engaging a shoulder in the respective cavity, to latch the terminal therein. The terminal locking, insulating insert is provided to lock the terminals in their cavities against the action of vibration, for example where the product is used in a motor vehicle, or against accidental pulling of leads connected to the terminals when the vehicle is being serviced, for example, the latching lances formed integrally with the terminals being insufficiently robust to prevent the terminals from backing out from their cavities under such adverse conditions of use.

In the case of some terminals, for example small, circular cross section pin and socket terminals, latching lances cannot conveniently be formed integrally with the terminals, although it is essential that some latching means for the terminals be provided, to retain them in their cavities prior to the locking of the terminals. In any event such metal lances are easily damaged when the terminals are reeled for their application to the leads, or are otherwise handled. It is, however, in the case of the known housing, impractical, with the use of straight action mold cores, that is to say without cross-coring, to provide latching lances which are formed integrally with the walls of the terminal receiving cavities.

German Publication 3729751-A shows a latch which is integral with the wall portion. The wall portion defines a part of the terminal receiving cavity, as shown in FIG. 5, yet is moveable to receive the terminals, as shown in FIG. 7. When the receptacle is placed over the housing, the locking member resides beneath the wall parts to prevent their movement. Unlike the present invention, the receptacle does not complement the wall portion to complete the terminal receiving cavity.

SUMMARY OF THE INVENTION

According to one aspect of the invention, each cavity is provided with a terminal latching lance formed integrally with the housing and extending longitudinally of the cavity, the housing having an intermediate face between said front and rear faces and from which said latching lances extend, a length of each cavity between the front face and the intermediate face being in the form of a first open channel, the channels of the first cavities opening towards those of the second cavities and vice versa, and the length of each cavity between the rear face and the intermediate face being tubular, said insulating insert having first and second arrays of second open channels each of which is complementary with a respective first open channel, said insert being insertable into the housing so that each first open channel cooperates with a second open channel to define open ended tube.

By virtue of said first open channels, the latching lances projecting from said intermediate face can readily be provided during the molding of the housing, by the use of straight action core pins.

According to a preferred embodiment of the invention, the insert and the housing having latching members which are interengagable, releasably to secure the insert initially in a partially inserted position in the housing to allow electrical terminals to be inserted into the cavities by way of the rear face, and finally to secure said insert in a fully inserted position in the housing in which the insert maintains the latching lances in locking relationship with the terminals in the cavities.

Thus the insert can be secured in its partially inserted position, the terminals inserted into the cavities by way of said rear face, and the insert pushed into its fully inserted position from the front of the housing to lock the terminals in their cavities.

Said latching members may comprise latch arms projecting from the insulating insert for reception in first and second sockets opening into the intermediate face of the housing, first latching shoulders in the first sockets, which shoulders are proximate to the intermediate face, and second latching shoulders in the second sockets which shoulders are remote from said intermediate face.

Also, for ready molding of the housing, the first open channels of the second cavities may be defined by longitudinal grooves in a post projecting into the housing from said intermediate face, centrally thereof.

For mounting the housing to a panel, the housing may be formed with an external peripheral collar and external latches for securing the housing in an opening in the panel with the rear face of the housing on one side of the panel, and a hood projecting from the front face of the housing for receiving a mating electrical connector housing, on the other side of the panel, the hood being externally screw threaded to mesh with screw thread engaging means in a locking ring surrounding mating connector housing.

The mating connector housing, may be formed with an external peripheral flange extending thereabout proximate to the rear face of the housing and having a first sealing ring lodged there against, the housing being surrounded by the locking ring and the sealing ring engaging the internal periphery of the locking ring in sealing tight fashion. The locking ring may have internal projections for meshing with the screw thread and an external peripheral collar surrounding front face of the housing and about which, a second sealing ring extends for sealing engagement with the margin of the opening in the panel.

For ready molding thereof, and for economy of the material thereof, the terminal locking insert may comprise a plain body from which extends normally thereof, at least one terminal locking bar for insertion between said rows of first open channels, to support said locking lances therein to lock the terminals in their cavities, said bar being corrugated so that opposite faces of the terminal locking bar define said second open channels and said body being formed with a through opening in alignment with each second open channel, in order to allow the pins of the terminals, where the terminals are pin terminals, to project outwardly of said planar body or, where the terminals are socket terminals, to allow the pins of pin terminals to be mated with the sockets. Side walls of the second open channels serve to restrain lateral deflection of the locking lances.

The cavities, may for example, be arranged in pairs of arrays of cavities, there being for example three such pairs of arrays, the total number of cavities being 35 for example, the latching lances and the first open channels of the cavities of each pair of arrays being oppositely the oriented, and the terminal locking insert having a respective terminal locking bar for insertion between the cavities of pair of arrays thereof.

According to a preferred embodiment of the invention, the terminal locking insert and the housing are provided with latching members, which are interengageable, releasably to secure the insert initially in a partially inserted position in the housing to allow electrical terminals to be inserted into the cavities by way of the rear face of the housing, and finally to secure the insert in a fully inserted position in the housing in which the insert maintains the latching lances in overlapping relationship with abutments of the terminals in the cavities. Such latching members may project normally from the planar body of the locking insert, in the same direction as the locking bar or locking bars thereof or, the body may be provided with a hood either fully or partially surrounding the locking bar or locking bars and being provided with a latching means, for example latching recesses or latching projections for cooperation with complementary means in the housing.

The cavities may be arranged in only two arrays, one array comprising, for example, three cavities and the other array comprising only two cavities. In the case of such an embodiment, the terminal locking insert is provided with only one terminal locking bar.

Either the body, or the hood, where such is provided, of the terminal locking insert may be formed with external keys and keyways for guiding it into the housing, or into a hood thereof for receiving a mating connector housing.

Mating connector housings, each comprising a terminal locking insert, are preferably so arranged that when the housings are mated, the planar bodies of the inserts of the two housings are in abutment.

For a better understanding of the invention and to show how it may be carried into effect, an embodiment thereof will now be described by way of example with reference to the accompanying drawings.

BRIEF DESCRIPTION OF THE DRAWINGS

Fig. 3 is a view, partly in a longitudinal section, showing the housings of the connectors of the assembly of FIG. 1, each housing having releasably secured therein, in a partially inserted position, a terminal locking, insulating insert.

FIG. 8 is end view of the insulating insert of the socket connector housing.

FIG. 9 is a side view of FIG. 8, shown partly in section.

FIG. 13 is an enlarged longitudinal sectional view through a cavity of the housing of the socket connector with the insert in its partially inserted position.

FIG. 18 is a rear view of an electrical connector housing according to a first embodiment of the invention, for receiving a terminal locking insert therein and comprising a coupling ring.

FIG. 23 is an enlarged fragmentary, longitudinal sectional view illustrating a terminal receiving cavity of the housing.

FIG. 30 is a plan of the terminal locking insert shown partly in axial section.

FIG. 31 is a side view shown partly in axial section, of the coupling ring.

FIG. 32 is a rear view of the housing with the terminal retainer in a terminal insertion position therein.

FIG. 33 is a view taken on the lines 33—33 of FIG. 32.

FIG. 34 is a front view of the housing with the terminal locking insert therein in said terminal insertion position.

FIG. 35 is a similar view to that of FIG. 23 but showing the terminal locking insert in its terminal insertion position.

FIG. 36 is a similar view to that of FIG. 35 but showing an electrical terminal in the cavity and the terminal locking insert in a terminal locking position.

FIG. 37 is a rear view of an electrical connector pin housing according to a second embodiment of the invention, for receiving a terminal locking insert therein.

FIG. 38 is a view taken on the lines 38—38 of FIG. 37.

FIGS. 39, 40 and 41 are a front view, a side view, and a top plan view, respectively, of the housing of FIGS. 37 and 38.

FIG. 49 is a longitudinal sectional view of the housing of FIGS. 37 to 41 with the terminal locking insert of FIGS. 42 to 48 therein in a terminal locking position.

FIG. 53 is a rear view of an electrical socket housing according to a third embodiment of the invention, for mating with the housing of FIGS. 37 to 41 and for receiving a terminal locking insert therein.

FIG. 54 is a view taken on the lines 54—54 of FIG. 53.

FIGS. 55 and 56 are a front view and a side view, respectively, of the housing of FIGS. 53 and 54.

FIG. 60 is an enlarged fragmentary view illustrating details of FIG. 58.

FIGS. 61 to 63 are a side view, a top plan view and an underplan view, respectively, of the terminal locking insert of FIGS. 57 to 60.

FIGS. 64 to 66 are a rear view, a longitudinal sectional view, and a front view, of the housing of FIGS. 53 to 56 with the terminal locking insert of FIGS. 57 to 63 in a terminal insertion position therein.

FIG. 67 is an enlarged fragmentary sectional view showing a cavity of the housing of the third embodiment, and showing an electrical socket terminal in the cavity, in fragmentary form, the terminal locking insert being in a terminal locking position.

As shown in FIG. 1, a bipartite electrical connector assembly comprises a mating pin connector 2 and socket connector 4, electrical terminals of which are electrically connected insulated electrical leads L1 and L2, respectively, the pin connector 2 being mounted a circular hole H a mounting panel P, both of the connectors 2 and 4 being of overall circular cross section. The connector 2 comprises an insulating housing 6, the connector 4 comprising an insulating housing 8 surrounded by a coupling ring 10 having therein means, described below, for meshing with a double screw thread 12 extending about the exterior of a hood 14 projecting forwardly from the housing 6. As shown in FIGS. 2, 3, 4 and 6 each of the housings 6 and 8 has a terminal receiving, rear face 16, a front face 18 opposite thereto an array of terminal receiving, first through cavities 20 proximate to a circular periphery 22 between the faces 16 and 18, and an array of terminal receiving second through cavities 24 disposed within the array of first cavities 20, each cavity 20 and 24 opening into both of the faces 16 and 18 of the respective housing. The assembly also comprises a pair of terminal locking, insulating inserts 26 and 28 respectively, for the housings 6 and 8, respectively. Each housing 6 and 8 has an intermediate face 30 between its faces 16 and 18 and from which extend outer and inner arrays of latching lances 32 and 34 respectively longitudinally of each cavity 20 and 24. Between the front face 18 and the intermediate face 30 of each housing 6 and 8, each cavity 20 and 24 is in the form of first open channel 36, the channels 36 of the cavities 20 opening towards the channels 36 of the cavities 24 and vice versa, as best seen in FIGS. 4, 6 and 15, the length of each cavity 20 and 24 between the rear face 16 and the intermediate face 30 of the respective housing 6 or 8, being in the form of an open ended tube 38 (FIG. 3). Each latching lance 32 has, intermediate its ends, a latching nose 40 protruding into the channel 36 of the respective cavity 20 or 24. Each insert 26 and 28 has an inner and an outer annular array of second open channels 42 and 44 respectively, as best seen in FIG. 8, which are complementary with respective ones of the channels 36. Each insert 26 and 28 is insertable into a fully inserted position in its respective housing 6 or 8 as described below, so that each channel 36 cooperates with a respective channel 42 or 44 to define an open ended tube as best seen in FIGS. 5 and 17. Each insert 26 and 28 has a circular array of latch arms 43 which are interengagable with latching shoulders 45 (best seen in FIGS. 10 and 12) of the respective housing 6 or 8, releasably to secure the insert 26 or 28, in a partially inserted initial position in its respective housing 6 or 8, in order to allow electrical pin terminals 48 and electrical socket terminals 50 (FIGS. 14 and 14A) to be inserted into the cavities 20 and 24 of the housings by way of the rear faces 16 thereof. In the partially inserted position of each insert 26 and 28, as will be apparent from FIGS. 3, 13, 14 and 14A, the lances 32 are free to flex to allow the insertion of the terminals, since they are not engaged by the respective insert 26 or 28 as shown in full lines in FIGS. 14 and 14A. The terminals are, however, latched in their cavities when they have been inserted thereinto, since the nose 40 of each latching lance overlaps a shoulder 52 of the respective terminal, as shown. The arms 43 of each insert 26 and 28 are interengagable with latching shoulders 46 in the respective housing to secure the respective insert 26 or 28, in said fully inserted position in which position each insert supports each latching lance 32 in the respective housing with its latching nose 40 overlapping the shoulder 52 of the respective terminal as indicated in broken lines in FIGS.

14 and 14A, so that the terminal is locked in its cavity and can under no circumstances back out from its cavity.

Figure 14:
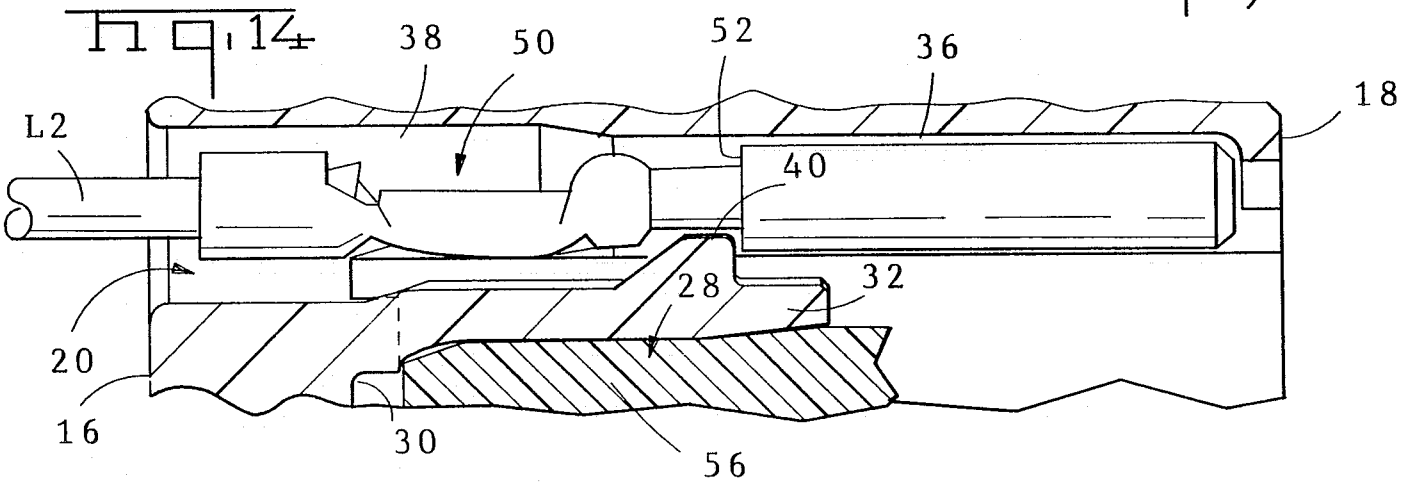
FIG. 14 is a similar view to that of FIG. 13 but showing an electrical socket terminal positioned in the cavity.
Figure 14A:
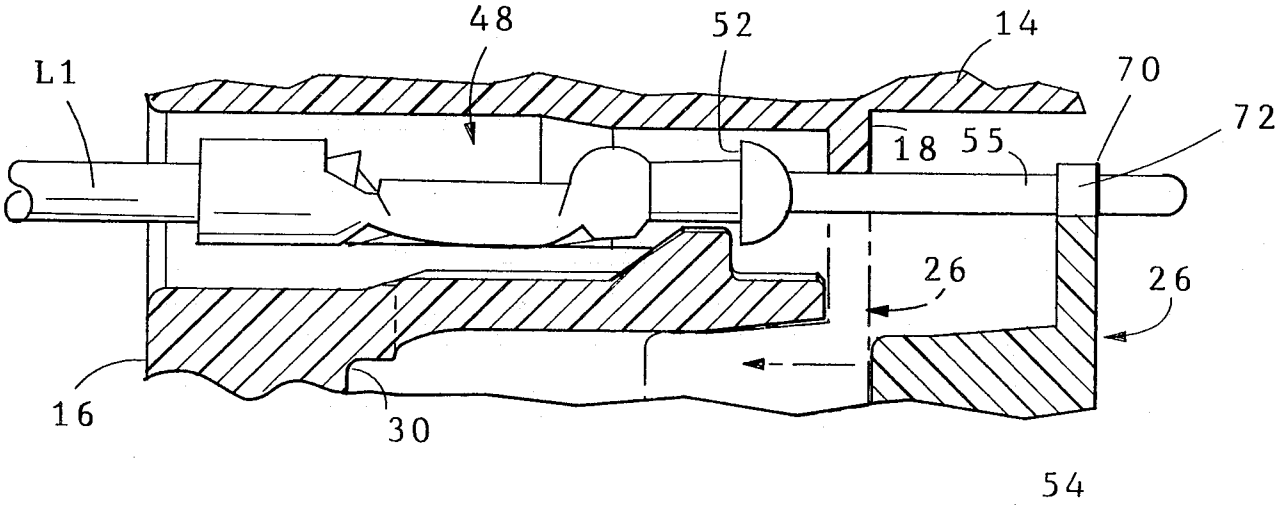
FIG. 14A is a similar view to that of FIG. 14 but showing a pin terminal in a cavity of the pin connector housing.

The latch arms 43 project from an overall circular cross section body of the insert, which is referenced 54 in the case of the insert 26, and 56 in the case of the insert 28. As will best be apparent from FIG. 3, the body 56 is longer than the body 54, since the cavities 20 of the housing 8 are longer than those of the housing 6. This is because pin portions 55 of the terminals 48 project from the cavities 20 of the housing 6 into the skirt 14, FIG. 14A, whereas socket portions 57 of the terminals 50 do not project from their cavities 20, FIG. 14. The latch arms 43 project from the body of insert 26 or 28, as the case may be, in the same direction and are substantially parallel to one another, each latch arm having a bifurcated leading end portion 58 defining spaced legs 60 and 62, each leg 60 being formed proximate to its leading end with a latching shoulder 64. Each housing 6 and 8, is formed with a circular array of sockets 66 and 67 which open into the immediate face 30 and extend through the rear face 16 of the housing and through individual extensions 68 projecting from the rear face 16. The latching shoulders 45 are provided in the sockets 66 proximate to the face 30, the latching shoulders 46 being provided in the sockets 67 within the extensions 68.

Figure 4:
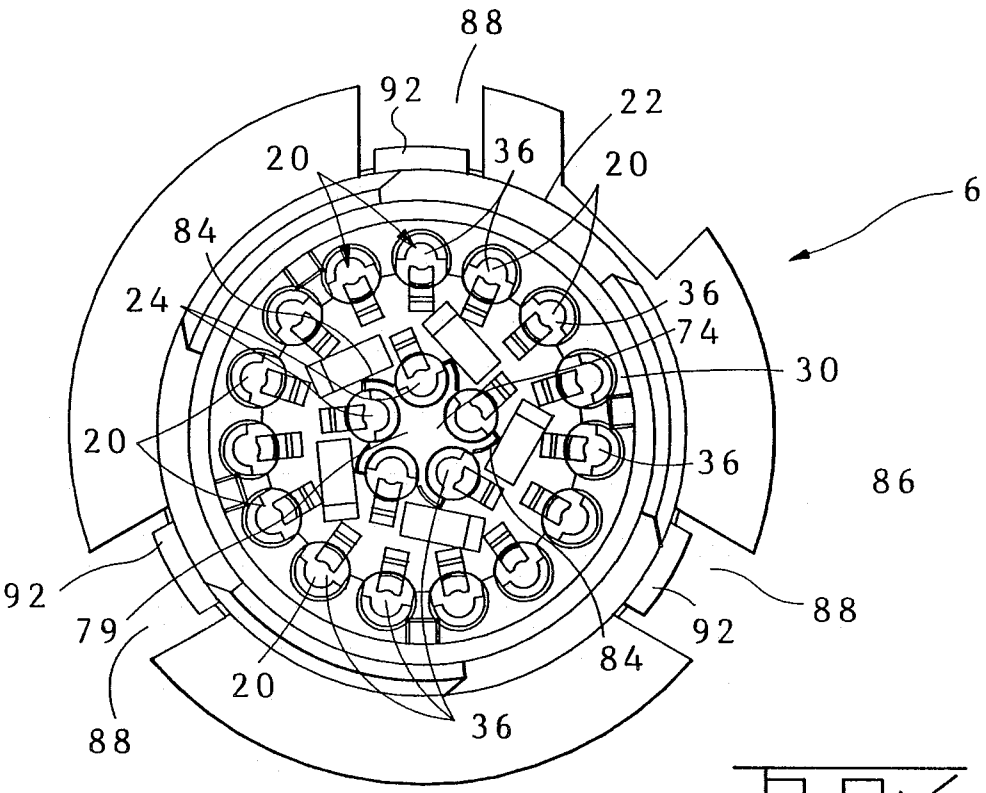
FIG. 4 is a view taken on the lines 4—4 of FIG. 3 showing the housing of the pin connector with the insert removed therefrom.
Figure 5:
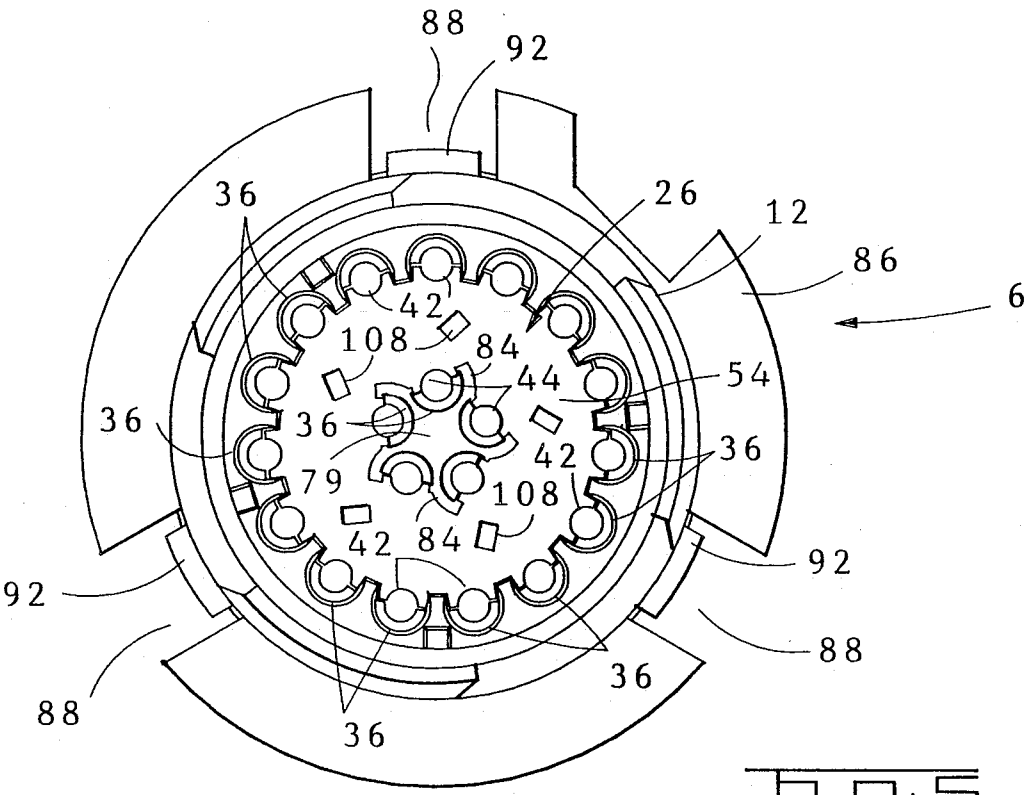
FIG. 5 is a similar view to that of FIG. 4, but showing the housing of the pin connector, with the insert in a fully inserted position herein.
Figure 6:
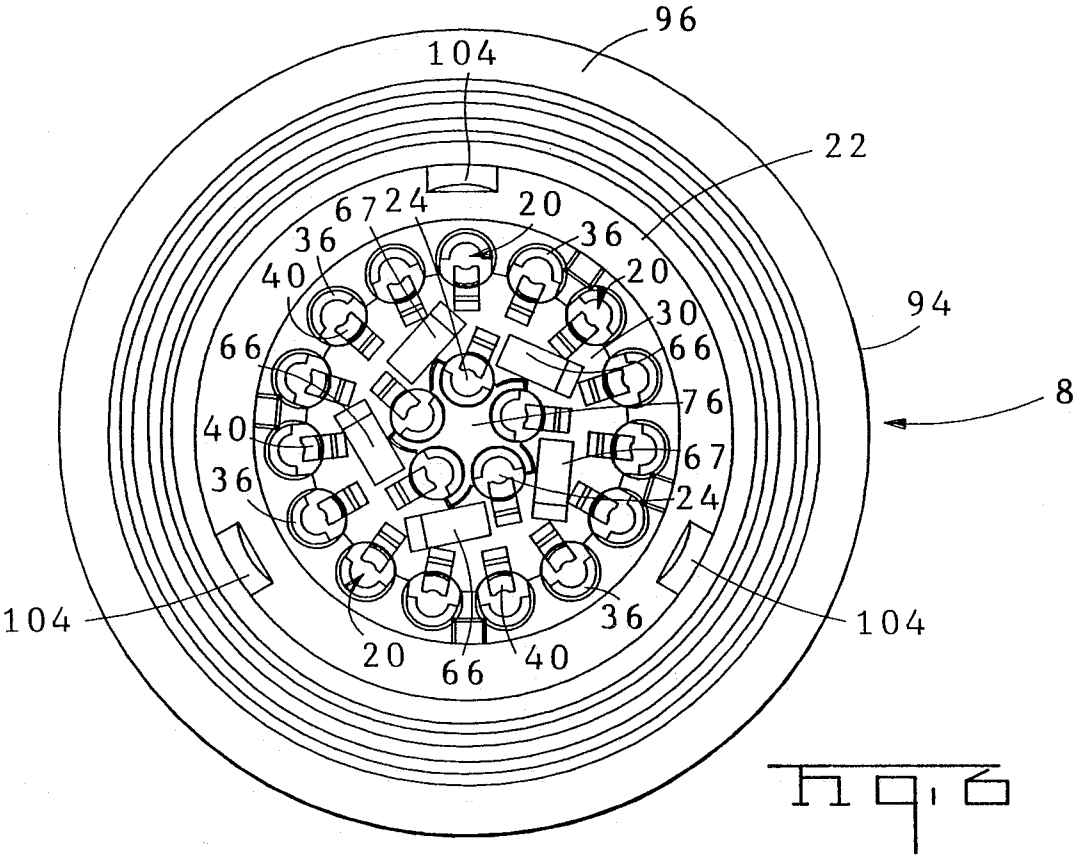
FIG. 6 is a view taken on the lines 6—6 of FIG. 3, showing the housing of the socket connector with the insert removed therefrom. p
Figure 7:
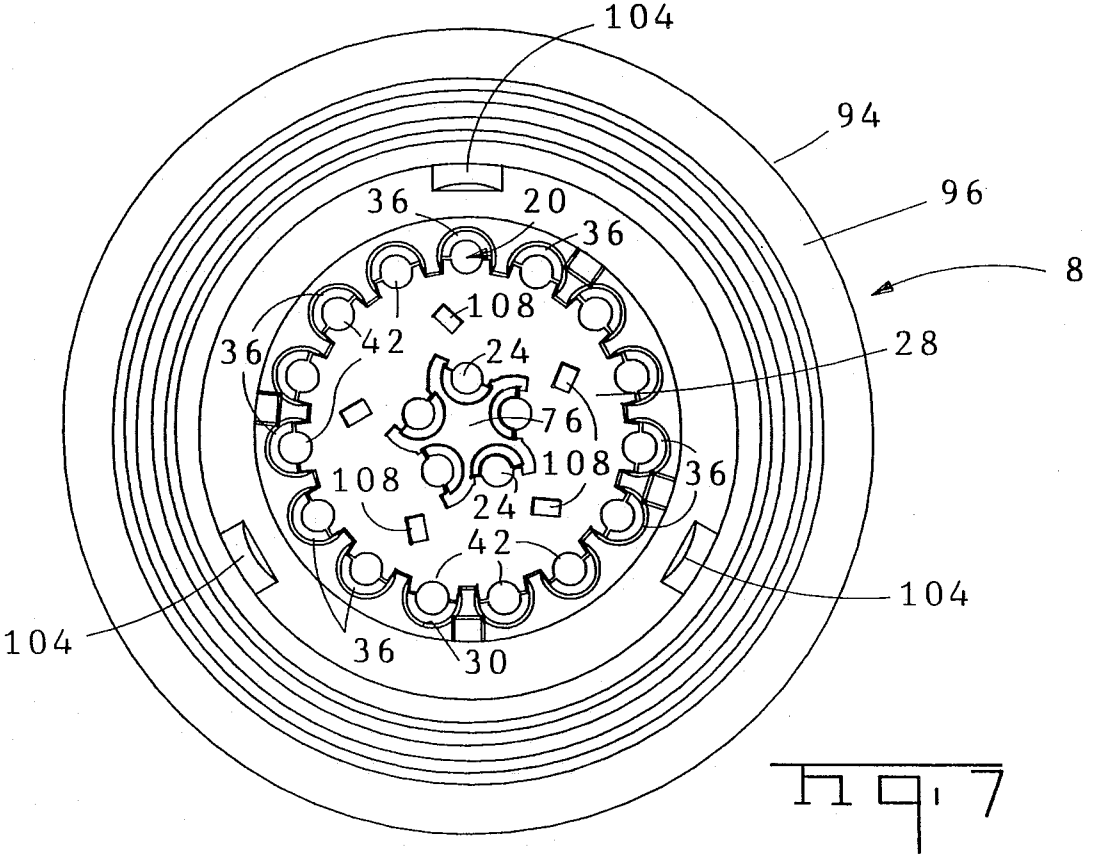
FIG. 7 is a similar view to that of FIG. 6, but showing the housing of the socket connector with the insert in a fully inserted position therein.

Each insert 26 and 28 has at the end of its body 54 or 56, remote from the latch arms 43, a peripheral collar 70 formed with openings 72 each in alignment with a respective channel 42 to receive the pin portion 55 of a respective terminal 48. In the case of the insert 26, this is to allow the pin portion 55 to project beyond the front face 18 into the hood 14 and in the case of the insert 28 to allow the pin portion 55 to mate with a respective socket portion 57 as the connectors 2 and 4 are mated. The channels 36 of the cavities 24 of the housing 6 are defined by longitudinal grooves in a post 74 projecting forwardly from the intermediate face 30 of the housing 6, the post 74 being of generally star-shaped cross section. The channels 36 of the cavities 24 of the housing 8 are defined by similar grooves in a post 76 projecting from the intermediate face 30 of the housing 8 and also being of substantially star-shaped cross section but configured in mirror image relationship with respect to the cross section of the post 74. A central opening 78 in the body 56 of the insert 28 is defined by the channels 44 and radiused recesses 80 for receiving the post 76. The body 54 of the insert 26 is formed with a similar opening 79 (FIG. 4) having similar recesses 84 arranged in mirror image relationship with respect to recesses 80, for receiving the post 74.

Figure 1:
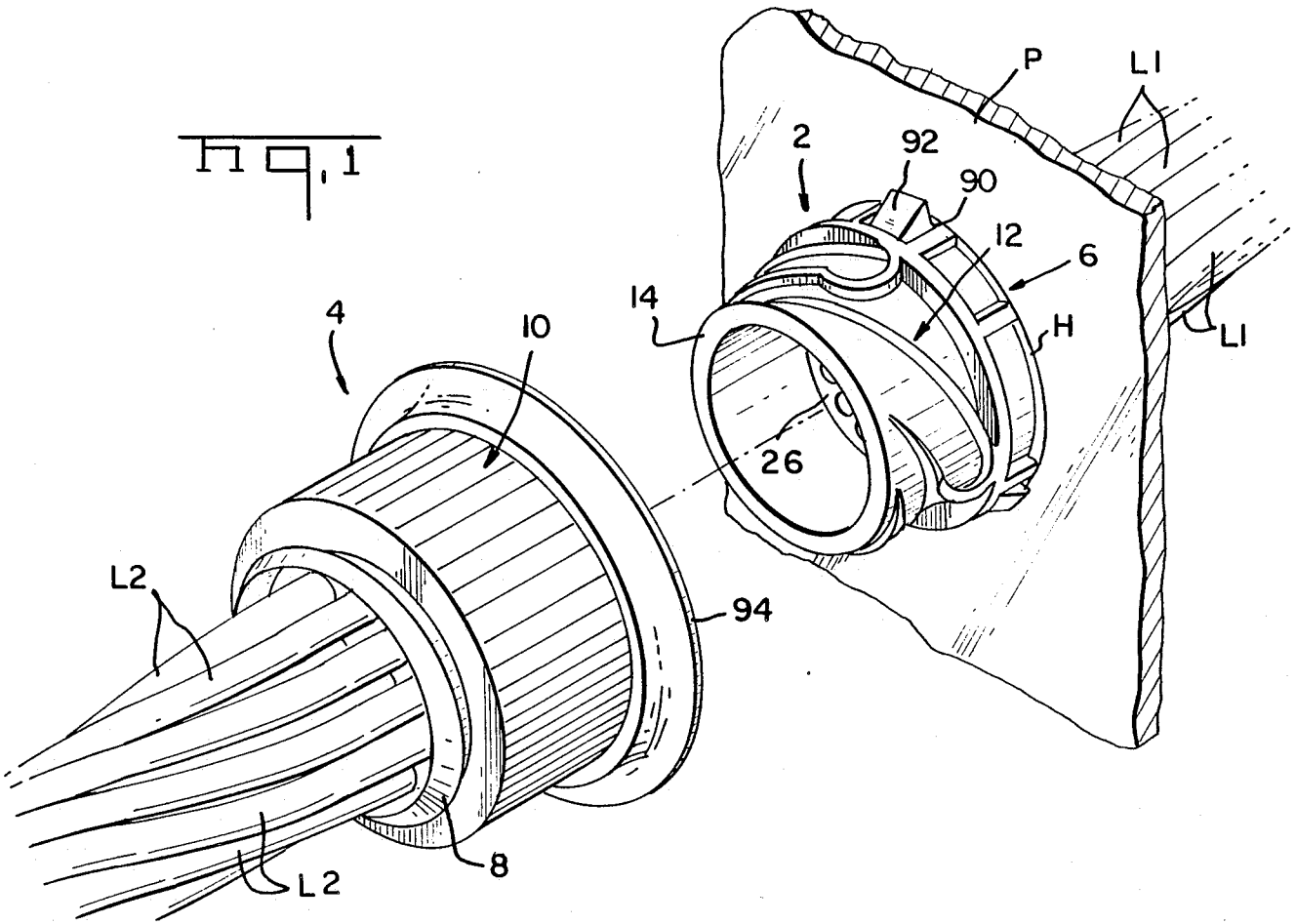
FIG. 1 is an exploded isometric view of a bipartite electrical connector assembly comprising pin connector and a socket connector, connector being latched in an opening in a panel.
Figure 2:
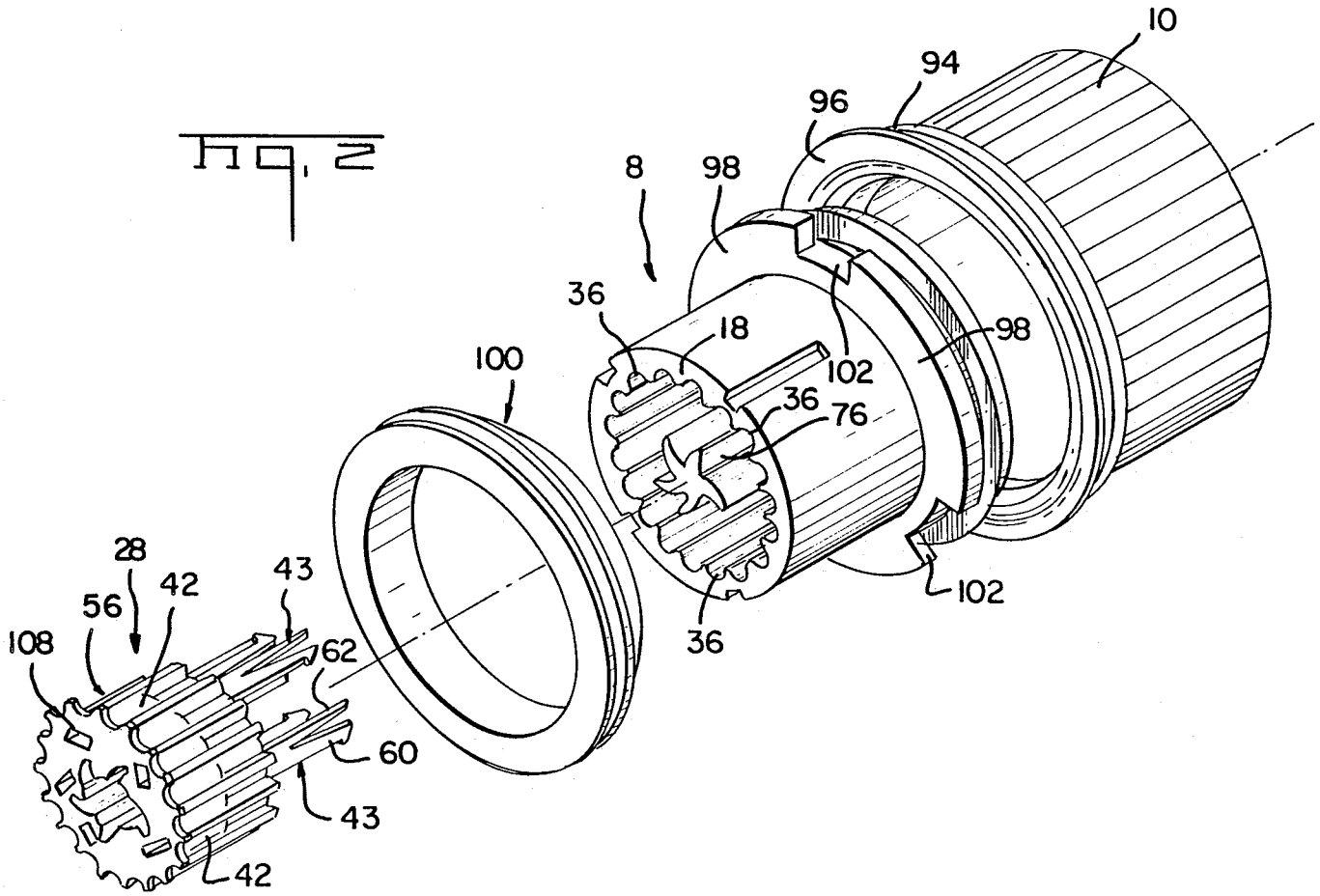
FIG. 2 is an exploded isometric view of the insulating housing of the socket connector.
Figure 1:
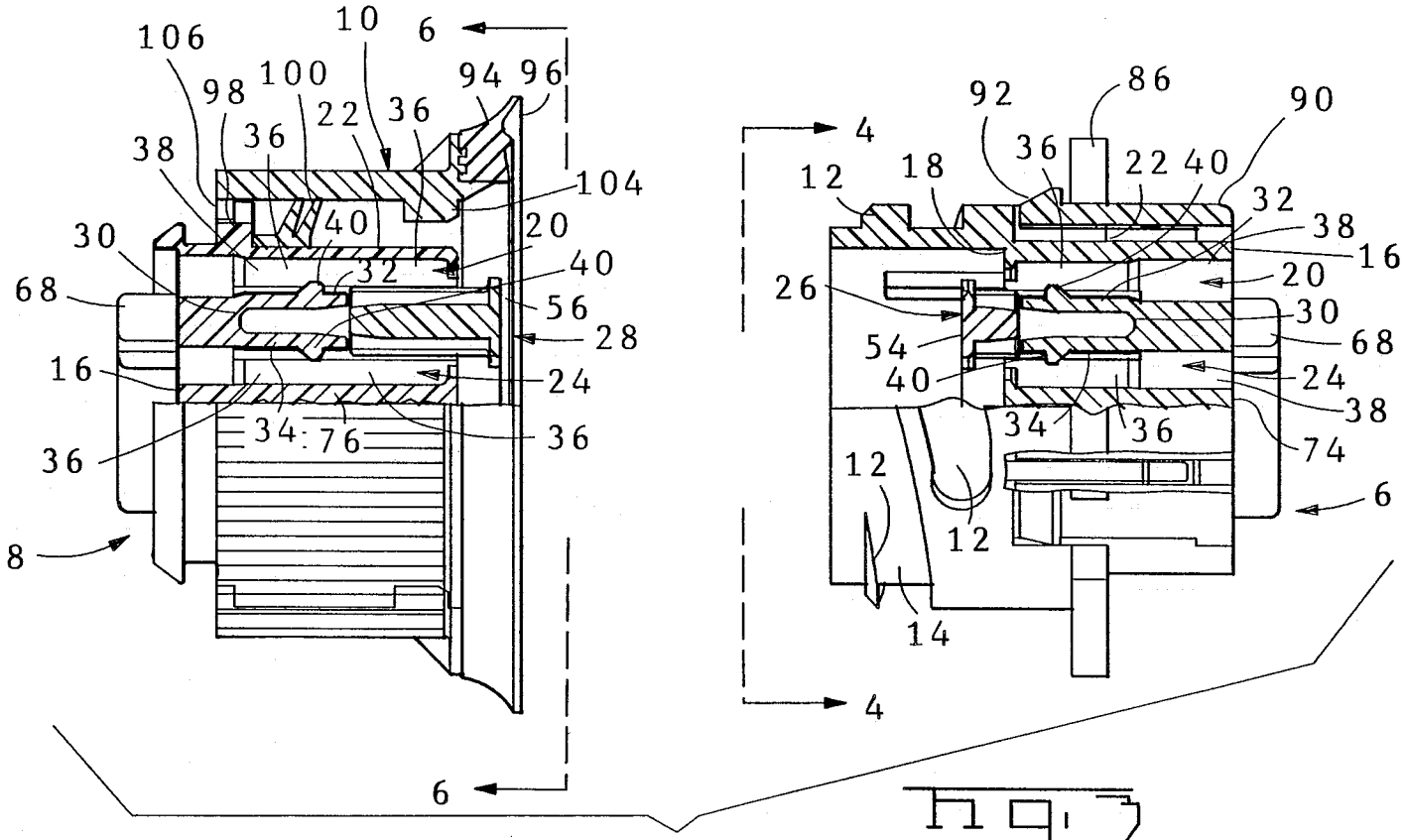

The housing 6 is formed with an external peripheral collar 86 having openings 88 therein through which project latch arms 90 formed integrally the external periphery of the housing 6 and having latching heads 92 which serve to lock the housing 6 in the hole H in the panel P in cooperation with the collar 86, as will be apparent from FIG. 1.

The coupling ring 10 is provided with a forward, external peripheral sealing ring 94 having a flat front face 96 for engaging the panel P about the margin of the hole H in sealing tight fashion. At its rear end, the housing 8 is formed with a peripheral external flange 98 against which is lodged a sealing ring 100 having a bifurcated portion engaging the internal periphery of the coupling ring 10, the flange 98 having spaced cut outs 102 to allow the housing 8 to be inserted through the forward end of the coupling ring 10 beyond internal studs 104 in the coupling ring 10 until the flange 98 abuts an internal rear end flange 106 in the coupling ring 10. The studs 104 serve as the means for meshing with the screw thread 12 of the hood 14.

Figure 11:
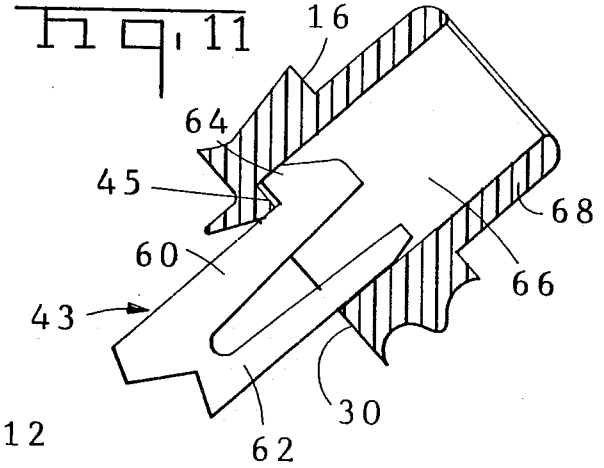
FIG. 11 is a view taken on the lines 11—11 of FIG. 10, and showing a latch arm of the insulating insert when the insert is in its partially inserted position.
Figure 12:
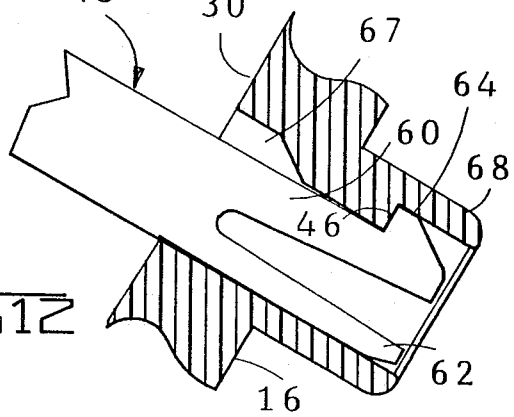
FIG. 12 is a view taken on the lines 12—12 of FIG. 10, and showing a further latch arm of the insulating insert, when the insert is in its fully inserted position.
Figure 10:
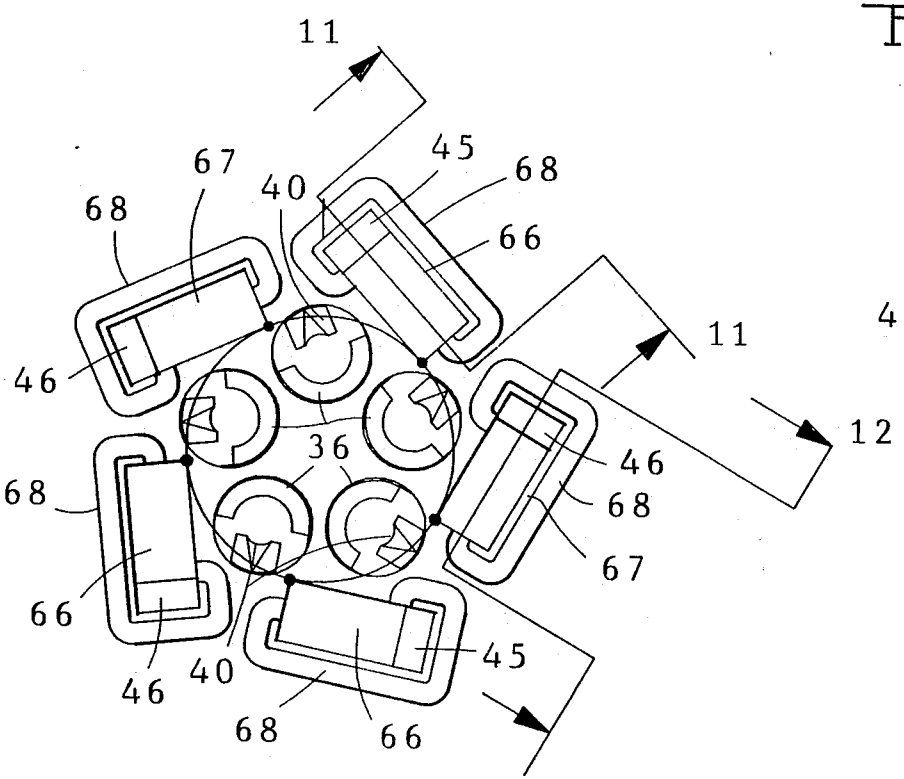
FIG. 10 is rear end view of the housing of the socket connector housing showing only the central part thereof.
Figure 11:
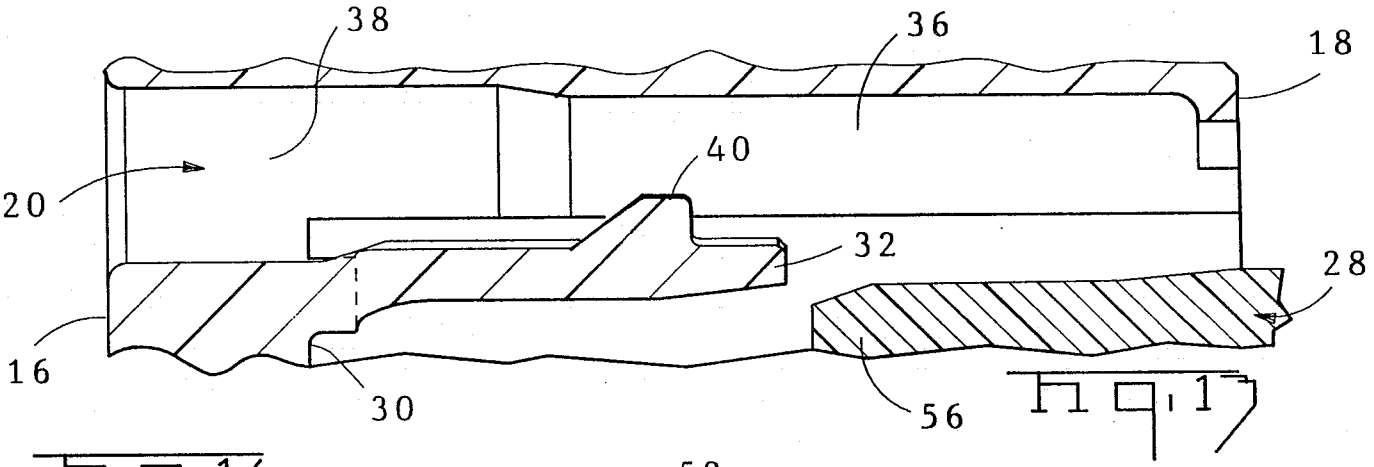

To provide the connector assembly, the inserts 26 and 28 are inserted into their respective housings 6 and 8, each from the front of the housing so that the latching shoulders 64 of the latch arms 43 each engage with a respective latching shoulder 45 as shown in FIG. 11, whereby each insert is retained in its partially inserted position, which as mentioned above, allows the terminals to be inserted into the cavities 20 of the housing by way of the rear face 16 thereof. The terminals are then inserted into the cavities 20 and 24 of the housings 6 and 8 and the housing 6 is latched into the hole 8 in the panel P in the manner described above. The insert 26 in the housing 6 is then pushed home from the front side of the panel P so its fully inserted position, so that the terminals 48 are locked in their cavities 20 and 24 in the housing 6. The insert 28 of the housing 8 is in turn pushed into its fully inserted position to lock the terminals 50 in the housing 8. The connector 4 so provided is then mated with the connector 2 in the panel P so that the terminals 48 and 50 are mated, electrically to connect leads L1 with the leads L2. The body of each insert 26 and 28 is formed with five, spaced rectangular through openings 108 through which tool blades (not shown) can be inserted in order to force the legs 60 and 62 of each latch arm 43 resiliently towards one another so that insert can be withdrawn from its housing.

A second embodiment of the invention will now be described with reference to FIGS. 18 to 36. A circular cross-section electrical connector housing 110 (best seen in FIGS. 18 to 23) molded from an insulating material, has a mating front face 112 and a terminal receiving rear face 114 opposite thereto. There open into each of the faces 112 and 114, six rows of terminal receiving through cavities 116, the cavities of the six rows being referenced 116*a* to 116, respectively. The rows of cavities are spaced from one another diametrically of the housing 110, there being three rows of cavities on each side of the longitudinal axis X—X of the housing 110. The cavities 116*a* are five in number, the cavities 116*b* and 116*d* being six in number, the cavities 116*c* and 116*e* being seven in number and the cavities 116 being four in number, so that there are 35 cavities 116 in all. The housing 110 has, between its faces 112 and 114, intermediate faces 118 from which extend arrays of cantilever latching lances 120 each of which projects into a respective cavity 116 longitudinally thereof. The lances in the cavities 116*a*, 116*c*, and 116*e* are referenced 120*x* and the lances in the cavities 116*b*, 116*d* and 116*f* are referenced 120*y*. Between the mating face 112 and the intermediate face 118, each cavity 116 is defined by an open channel 122. Each latching lance 120, has between its ends a latching nose 126 protruding into the open channel 122 of the respective cavity 116, and having a concave apex. Each lance 120 has a free forward end 123. Each channel 122 of each cavity 116 comprises a substantially semi-circular wall 127 extending from the intermediate face 118 up to the mating face 112. Each cavity 116 has a tubular rearward portion 124 defined by a wall 130 extending between the wall 127 and the terminal receiving face 114. The wall 127 terminates at the mating face 112 in a semi circular lip 128.

Figures 20, 21, 22:
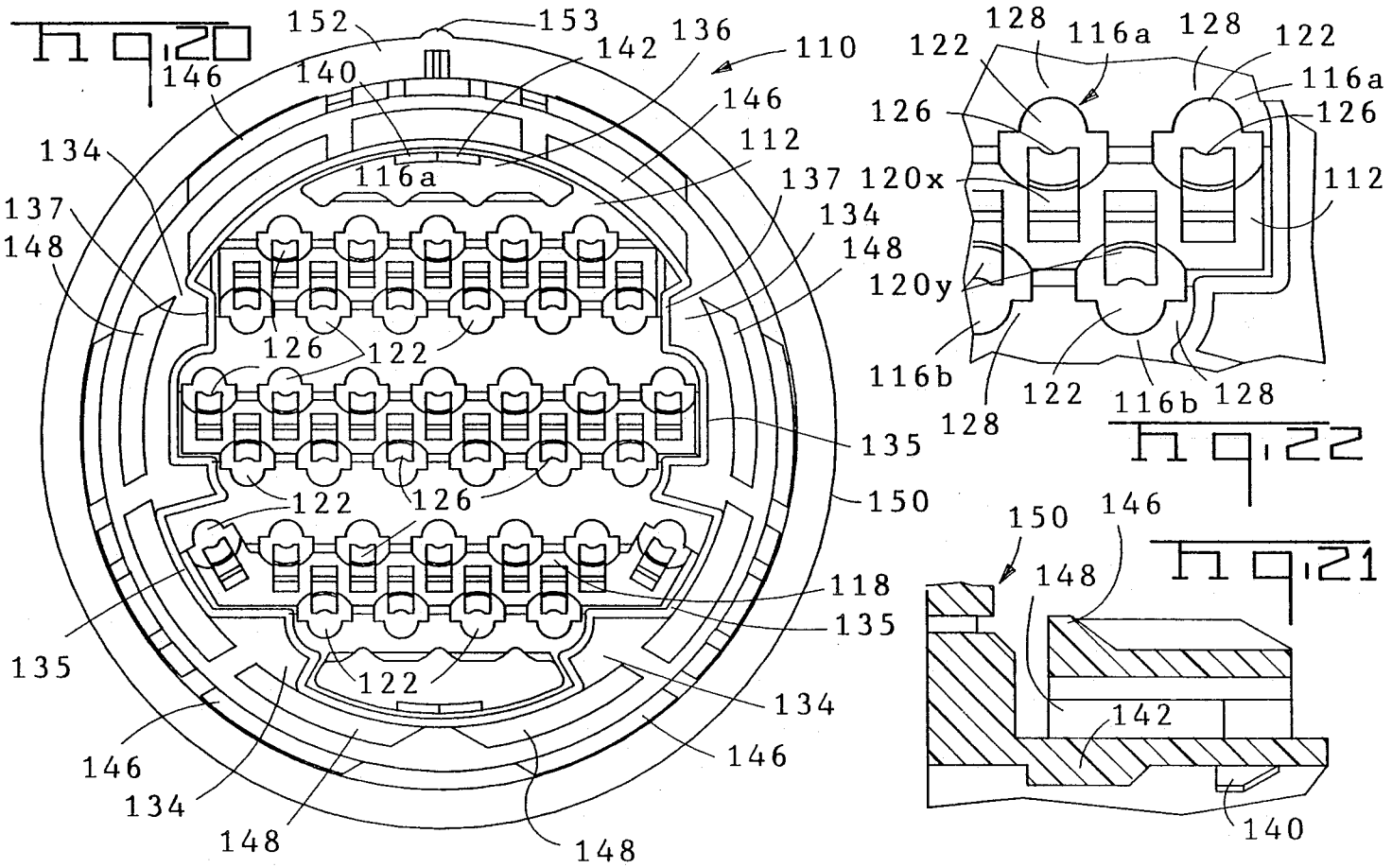
FIG. 20 is a front view of the housing.
FIG. 21 is an enlarged fragmentary view illustrating details of FIG. 19.
FIG. 22 is an enlarged fragmentary view illustrating details of FIG. 20.
Figures 26, 27:
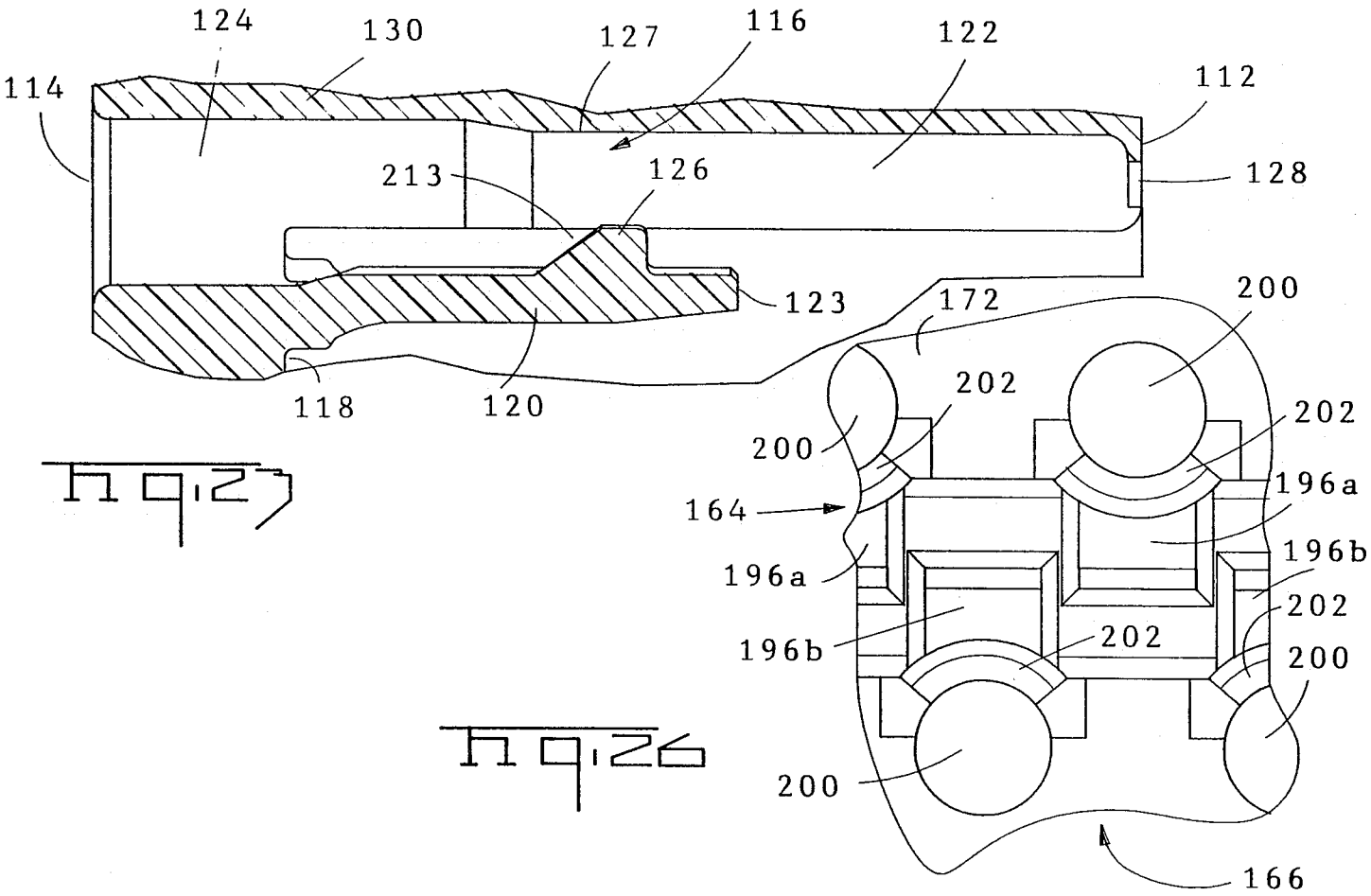
FIG. 26 is an enlarged fragmentary view illustrating details of FIG. 24.
FIG. 27 is a rear view of the terminal locking insert.
Figure 24:
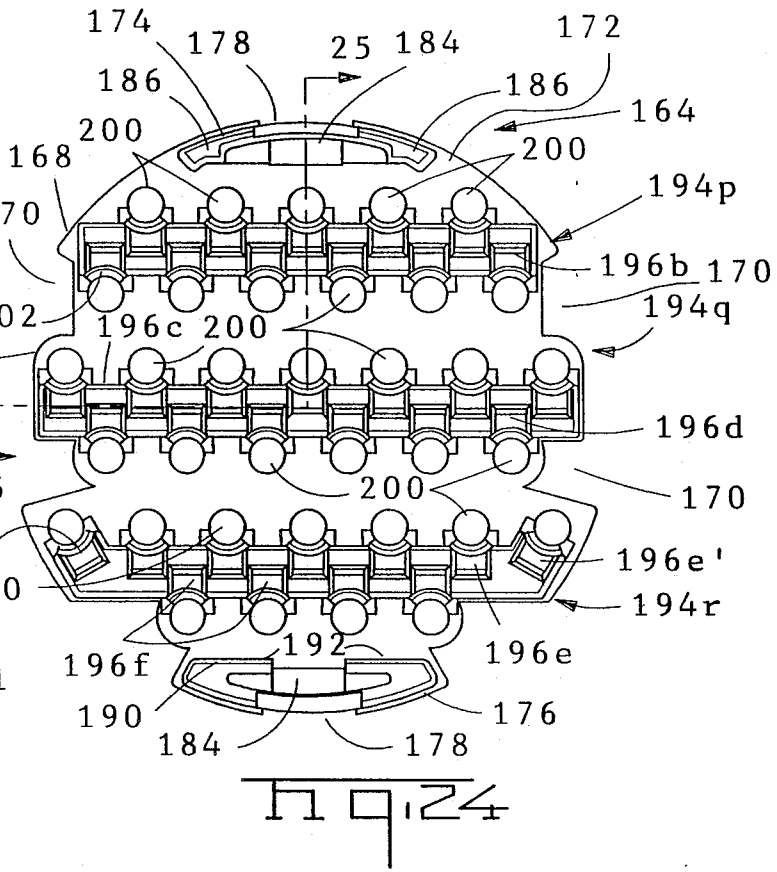
FIG. 24 is a front view of the terminal locking insert.
Figure 25:
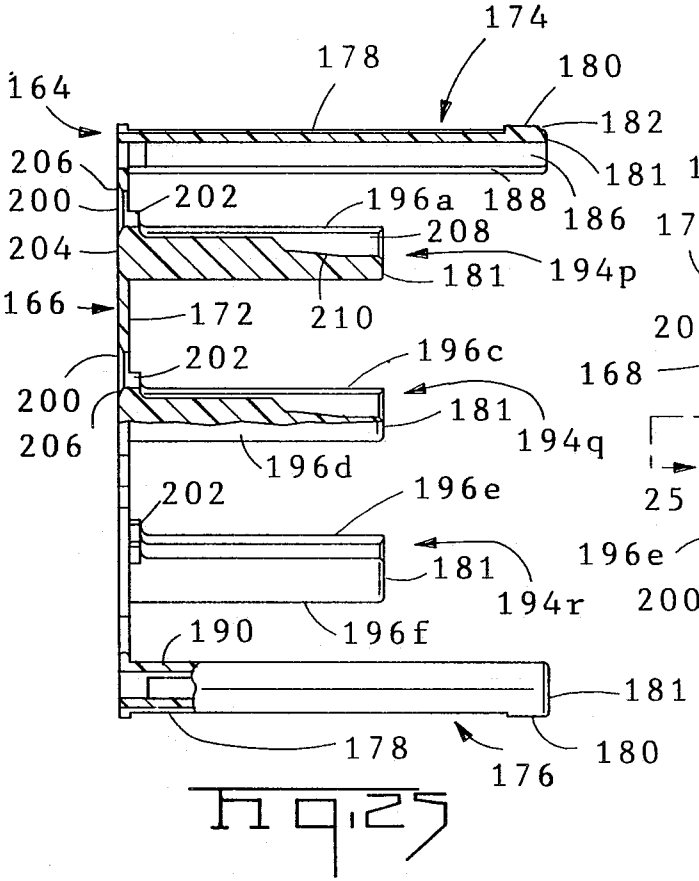
FIG. 25 is a view taken on the lines 25—25 of FIG. 24.
Figure 28:
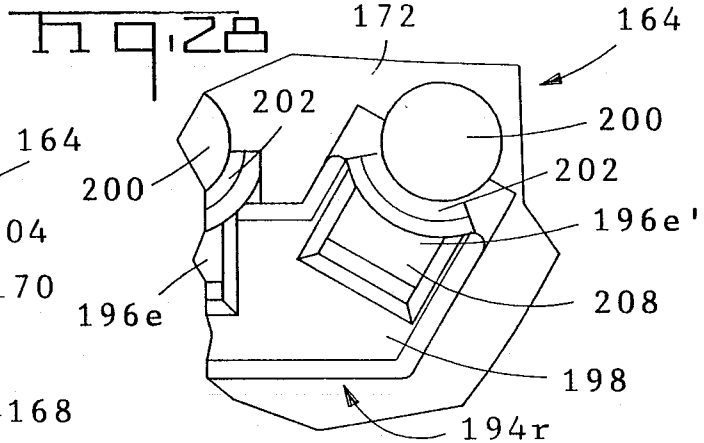
FIG. 28 is an enlarged fragmentary view illustrating a further detail of FIG. 24.
Figure 29:
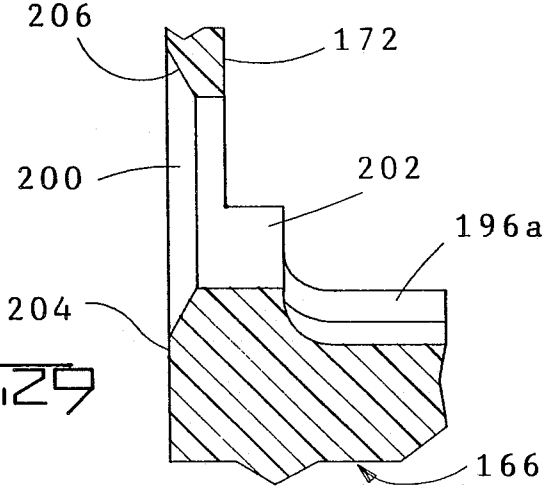
FIG. 29 is an enlarged fragmentary view illustrating a further detail of FIG. 25.
Figure 27:
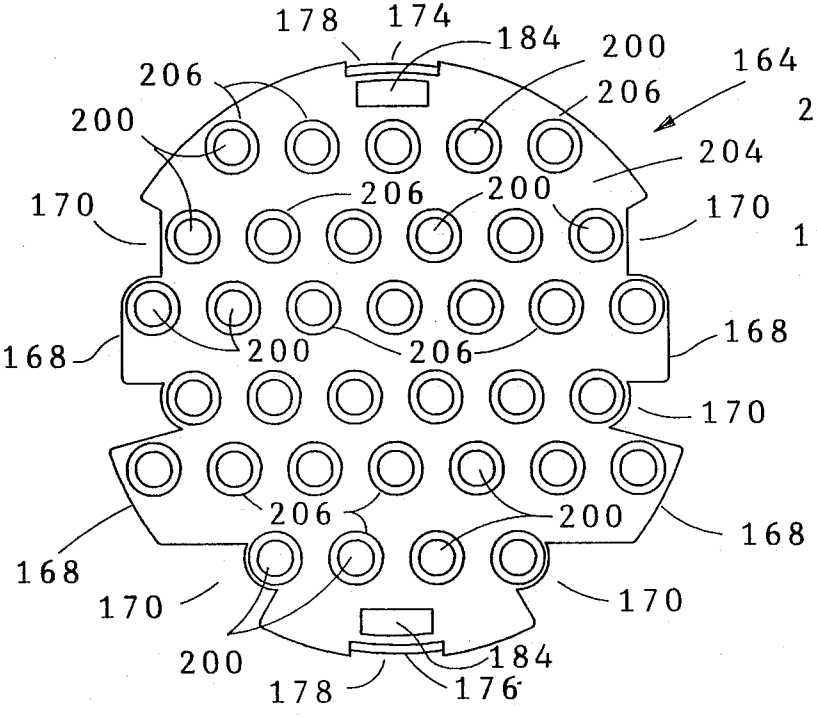
Figures 1, 17:
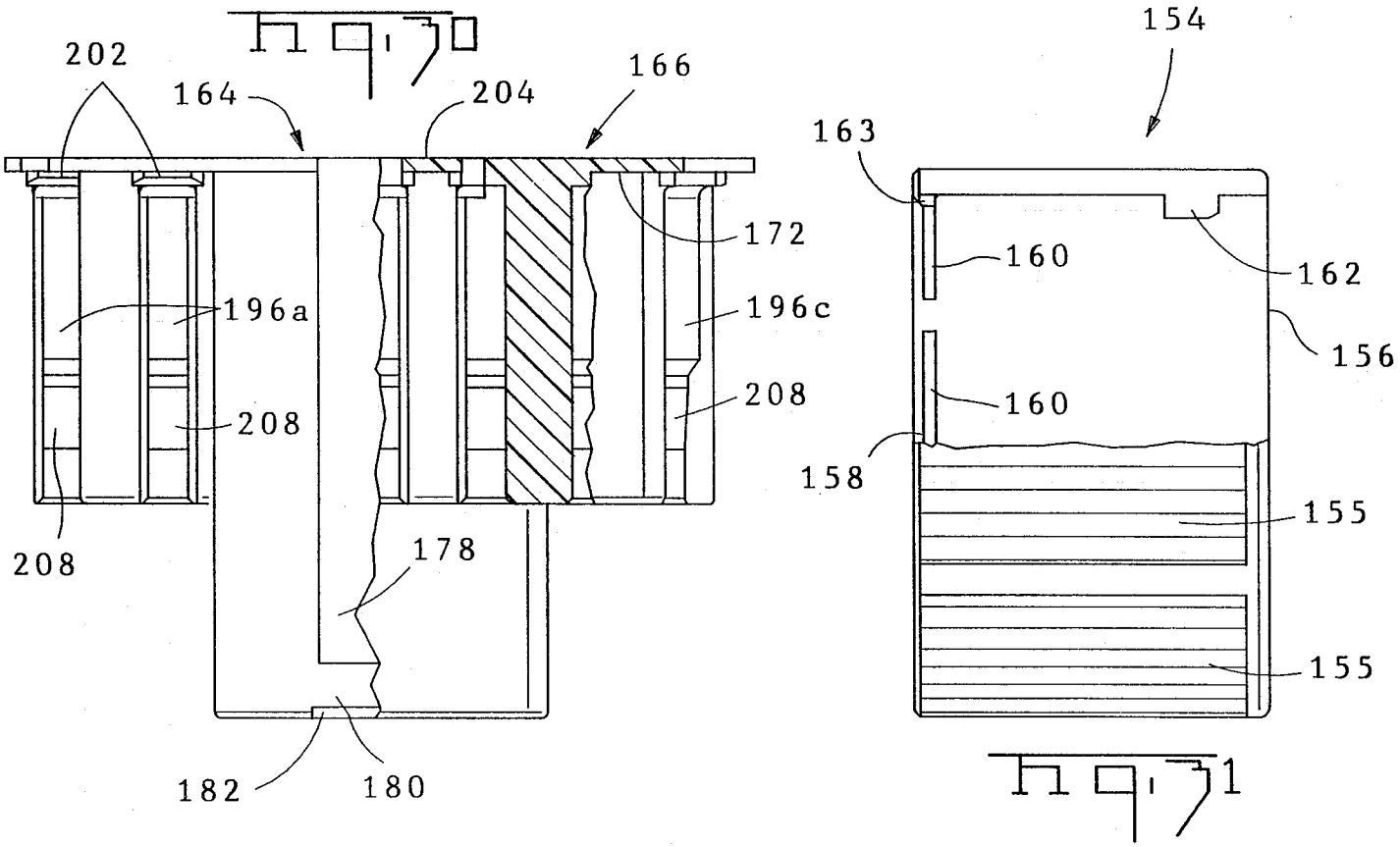
Figure 72:
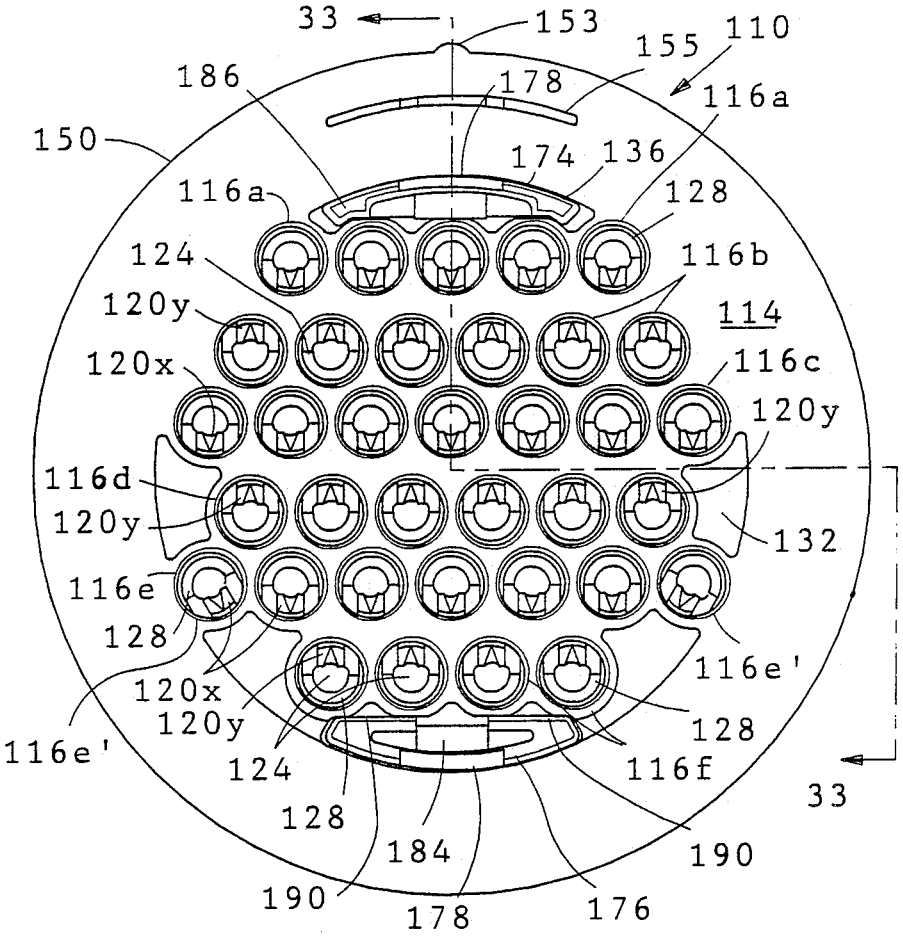
Figure 17:
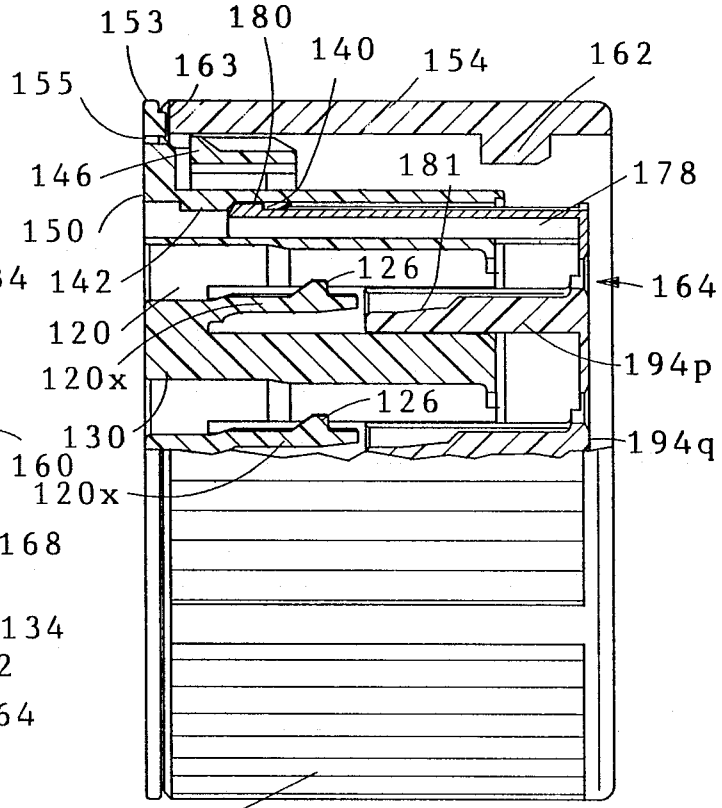
Figure 14:
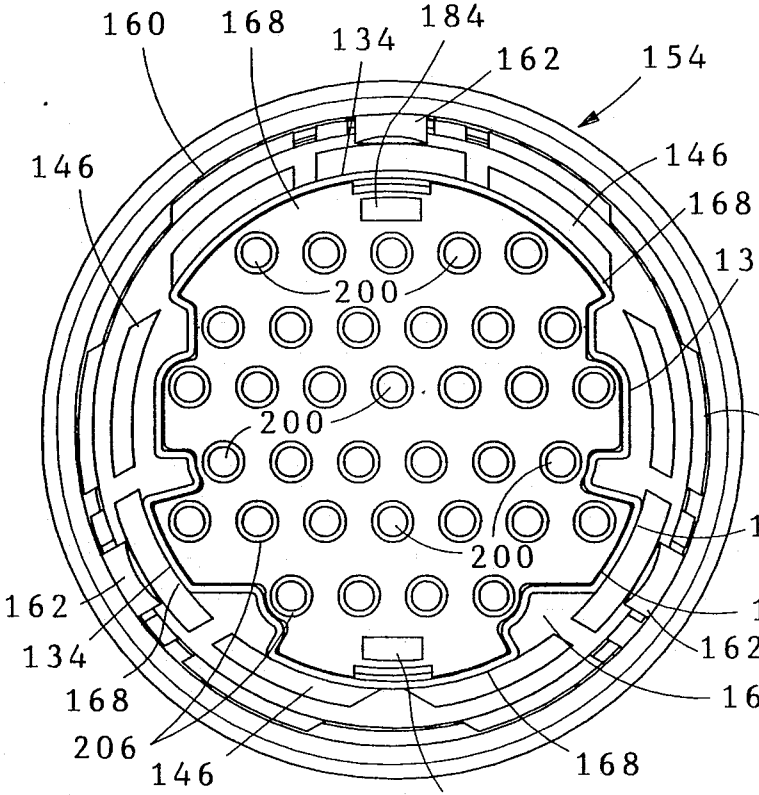

The walls 127 and the lances 120 of the cavities 116 of each pair of adjacent rows thereof, are, with the exception of those of two end cavities 116e', oppositely oriented. Thus, the lips 128 and the lances 120 of the cavities 116a, 116c and 116e are oppositely oriented with respect to those of the cavities 116b, 116d and 116, the lances 120x, accordingly being oppositely oriented with respect to the lances 120y, the latching noses 126 of the former, projecting upwardly and those of the latter projecting downwardly, as best seen in FIGS. 18, 20 and 22. The lips 128, the walls 127, and the lances 120x of the cavities 116e' are angled by about 125° outwardly to the housing 110 in respect of those of the adjacent cavities 116e.

As shown in FIG. 18, there are formed in the terminal receiving face 114, two opposed recesses 132 for the relief of warping of the molding material when the housing 110 has been molded. The housing 110 is formed about its periphery with external keyways 134, which open into the mating face 112 and which extend rearwardly therefrom for receiving polarizing keys on a mating housing (not shown). Keyways 134 serve to define internal keyways 135 and internal keys 137 for cooperation with external keys and keyways on a terminal locking insulating insert, described below, for reception in the housing 110. The keyways 135 and keys 137 are best seen in FIG. 20.

Figure 19:
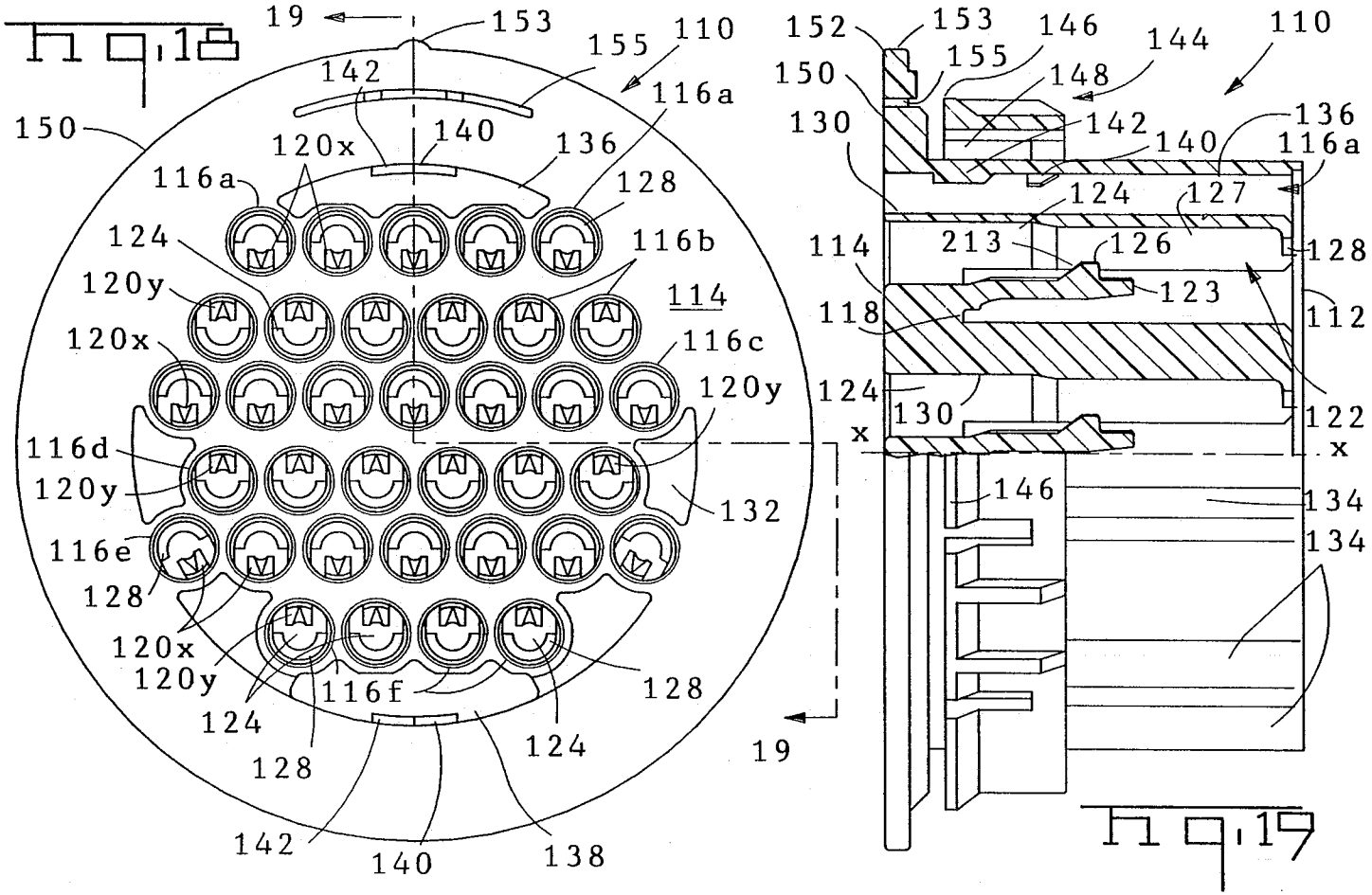
FIG. 19 is a view taken on the lines 19—19 of FIG. 18.

The housing 110 is also formed with diametrically opposed through sockets, 136 and 138, respectively, each for receiving a latch arm on the said terminal locking insert. The sockets 136 and 138, each of which opens into both of the faces 112 and 114, of the housing 110, are positioned radially outwardly of the row of cavities 116a and the row of cavities 116, respectively. In each socket 136 and 138 are first and second latching studs 140 and 142, respectively, which offset from each other, as best seen in FIG. 19. Each stud 140 is located nearer to the mating face 112, than the associated stud 142.

There extends about the periphery of the housing 110 a latching ring 144, formed integrally therewith and having latch arms 146 to which radial resilience is imparted by virtue of circumferential slots 148 in the ring 144. Proximate to the outer peripheral edge of the terminal receiving face 114 is an abutment collar 150 formed integrally with the housing 110 and having a rearward abutment face 152. The collar 150 is surmounted by a latching pip 153 which is resiliently depressible by virtue of a through slot 155 in the collar 150. A coupling ring 154 (as best seen in FIG. 31) with external finger grips 155, has a forward end 156, and a rear end 158 proximate to which are internal peripheral latching ribs 160 for engaging over the latch arms 146 with a snap action so that the end 158 of the ring 154 abuts the face 152, whereby the ring 154 is secured to the housing 110 but is rotatable thereabout. Proximate to the end 156 of the ring 154 are internal bosses 162 for engaging in a three start screw thread of said mating housing to couple the housing 110 thereto. The ring 154 has a latching recess 163 opposite to each boss 162 in each of which the pip 153 can resiliently engage, to retain the housing 110 in three alternative angular positions with respect to the ring 154.

In each of said angular positions the keys and keyways of the housing 110 can engage cooperating keyways and keys of the mating housing and each boss 162 can engage in a corresponding start of said three start screw thread. The ring 154 can be rotated out of any of said angular positions against the action of the pip 153, for coupling said housings.

The said terminal locking insert, which is generally referenced 164, will now be described with reference to FIGS. 24 to 30. Insert 164 comprises a planar body 166, of small thickness, which is of overall generally circular shape, but is formed with peripheral external keys 168 for engaging the keyways 135 of the housing 110 and external peripheral keyways 170 for receiving the keys 137 thereof. There project, normally of the leading face 172 of the body 166, at diametrically opposed positions, cantilever latch arms 174 and 176 respectively, each being formed with a longitudinal radially outer broad central groove 178 (best seen in FIG. 40) which terminates in a transverse latching rib 180 proximate to a free leading end 181 of the latch arm and having a chamfered edge 182. In order to enhance the resilience of the latch arms 174 and 176, the body 166 is formed with rectangular openings 184 beneath these latch arms. On its radially inner side, the latch arm 174 is formed near its longitudinal edges, with a pair of longitudinally extending pads 186 each having a concave inner face 188 adapted to the outer walls of the cavities 116a. The latch arm 176 has longitudinally extending, radially inner, pads 190 having flat surfaces 192 for engaging the radially outer walls of the cavities 116. There also project normally from the face 172 of the body 166, the three constantly spaced, terminal locking cantilever bars 194, these being referenced 194P, 194Q, and 194R, respectively. Each bar 194 is of corrugated form so as to define an inner and an outer array of open channels 196 each extending from the face 172 and opening into the free end 198 of the respective bar 194. The channels 196 of the outer array of the bar 194P are referenced 196a and those of the inner array the bar 194P are referenced 196b. The channels 196 of the outer array of the bar 194Q are referenced 196c and those of the inner array of that bar are referenced 196d. The channels 196 of the outer array of the bar 194R are referenced 196e and 196e' and those of the inner array of that bar are referenced 196f. In alignment with each channel 196, the body 166 is formed with a through circular opening 200, partially encircled by a segmental guide collar 202 projecting from the face 172 and having adjacent to the trailing face 204 of the body 166, a chamfered guide edge 206. Each channel 196, has, extending back from the free end 198 of a respective bar 194, a deepened part 208, the floor of which provides a latching lance support surface 210 which deepens slightly towards said free end 198 in the shallow steps.

Each cavity 116 is shaped and dimensioned to receive an electrical terminal 212 (FIG. 36) comprising a crimping ferrule 214 crimped to an electrical lead L and an electrical socket 216 connected to the ferrule 214 by way of a waisted transition portion 218, to define a rearwardly facing latching shoulder 220.

Figures 15, 16:
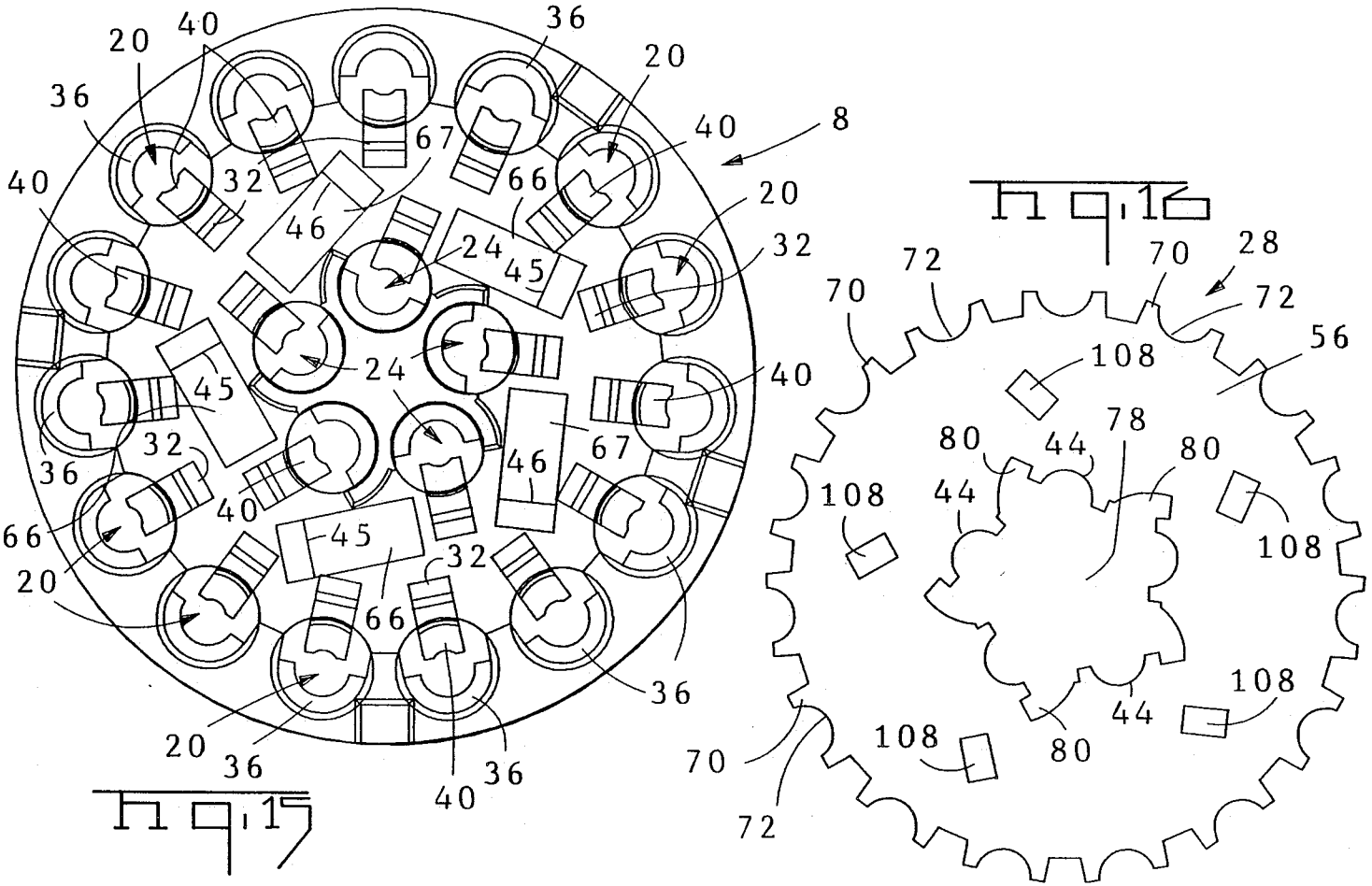
FIG. 15 is enlarged view of the central part of FIG. 6.
FIG. 16 is an enlarged end view of the insulating insert of the socket connector housing, showing the opposite end thereof to that shown in FIG. 8.
Figure 17:
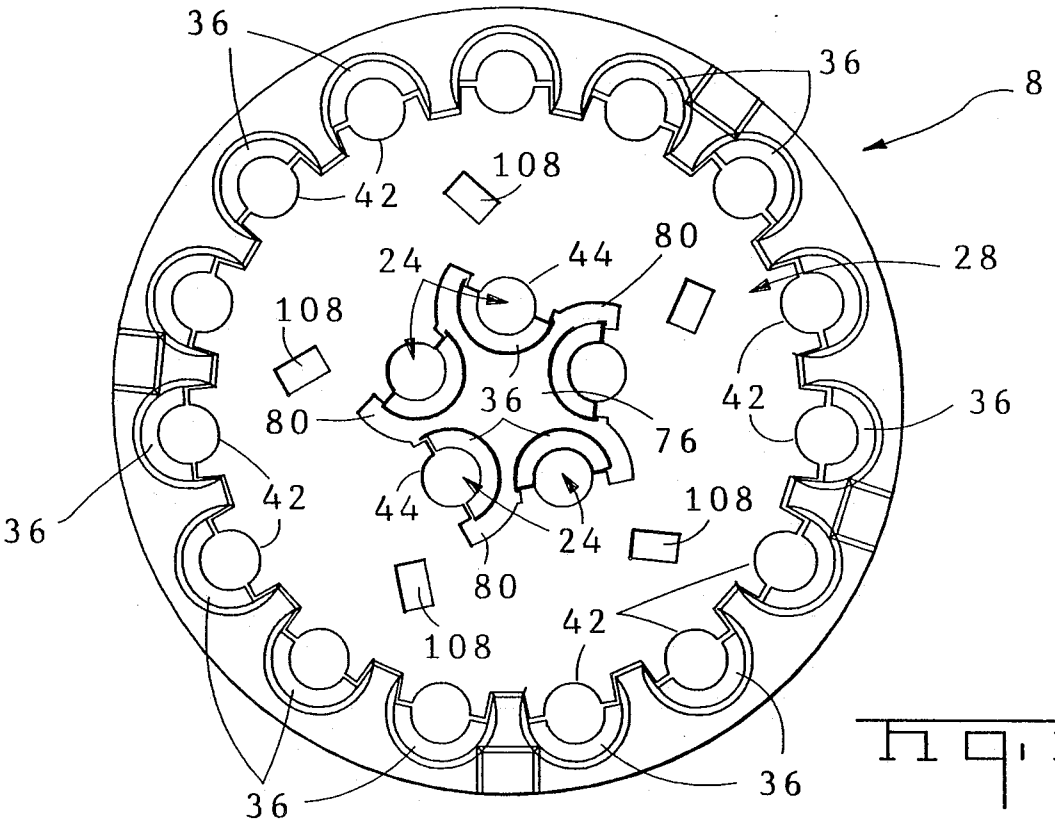
FIG. 17 is an enlarged end view of the central part of Fig. 7.

The coupling ring 154 having been secured to the housing 110 as described above, the terminal locking insert 164 is assembled to the housing 110 by inserting the leading ends 181 of the latch arms 174 and 176 into the sockets 136 and 138 respectively, from the mating face 112 until each rib 180 latches behind the respective first latching stud 140, as shown in FIG. 16. During the assembly of the insert 164, keys 168 thereof engage in respective complementary ones of the keyways 135 of the housing 110, keys 137 thereof being received in the keyways 170 of the body 166. The insert 164 can thus be assembled to the housing 110 only in in its correct orientation relative thereto. As shown in FIG. 32, the pads 186 of the latch arms 174 snugly engage the outer walls of the cavities 116*a*, the pads 190 resiliently engaging the outer walls of the cavities 116. The bar 194P engages between the cavities 116*a* and 116*b*, the bar 194Q engaging between the cavities 116*c* and 116*d* and the bar 194R engaging between the cavities 116*e* and 116 as will be apparent from FIG. 32. The insert 164 is now in its terminal insertion position, in which as will best be apparent from FIGS. 32, 33 and 35, the leading end 181 of each bar 194 is positioned proximate to, but forwardly of, the free ends 123 of the latching lances 120*x* and 120*y* of two rows of oppositely oriented pairs of latching lances 120.

A terminal 212 is now inserted into each cavity 116 from the terminal insertion face 114 of the housing 110, with the socket 216 leading so that it engages the rear inclined cam follower face 213 of the respective latching nose 126 of the lance 120 in the cavity 116, to deflect the lance radially inwardly, in the case of a lance 120*x* or radially outwardly in the case of a lance 120*y*. Upon full insertion of each terminal 212 into its cavity 116, the respective lance 120 resiles so that the nose 126 thereof overlaps the shoulder 220 of the terminal 212 so that the terminal 212 is latched in position in its cavity 116. No terminal 212 can therefore fall out of the housing 110 as it is being loaded with the terminals.

When the housing 110 has been fully loaded with terminals 212, the terminal locking insert 164 is pushed home into the housing 110 so that each rib 180 of the insert 164 latches behind the associated stud 142. The insert 164 is now in its terminal locking position, in which, as shown in FIG. 36, the free end 181 of each bar 194 lies rearwardly of the free end 123 of the respective lance 120 so that the forward part thereof is received in the deepened part 208 of the respective channel 196 whereby the lance 120 is supported against movement away from the terminal 212 by the support surface 210 which cams the lance 120 slightly towards the terminal 212 as the insert 164 is advanced from its terminal insertion, to its terminal locking, position. The nose 126 of each lance 120 is accordingly held in overlapping relationship with the respective shoulder 220 so that the terminal can, under no circumstances, back out from its cavity. In the terminal locking position of the insert 164, each channel 196*a* cooperates with respective open channel 122 of a cavity 116*a*, to define an open ended tube enclosing a forward part of the respective terminal 212. The channels 196*b* to 196 similarly cooperate with the channels 122 of the cavities 116*b* to 116 respectively. Each collar 202 cooperates with a respective lip 128 to define an opening for receiving an electrical pin P of a mating electrical terminal in said mating housing. The body 166 thus serves as a front plate for the housing 110.

insert 140, when in its terminal locking position prevents the lances 120 from being displaced, under the action of vibration, for example when the connector provided by the loaded housing 110 is in use, for example in a motor vehicle. The side walls of the deepened parts 208 of the channels 196 serve to prevent lateral movement of the lances 120.

The housing 110 and the insert 164 can readily be molded with the use of straight action core pins, cross-coring being unnecessary. The housing 110 can be supplied to a customer with the insert 164 in its terminal insertion position so that the risk of loss or damage to the insert is avoided.

The third embodiment of the invention will now be described with reference to FIGS. 37 to 52. As best seen in FIGS. 37 to 41 an electrical connector insulating housing 310 has a mating face 312 and a terminal receiving face 314 opposite thereto. There open into each faces 312 and 314, two parallel, spaced, superposed rows of terminal receiving through cavities 316, the cavities of these rows being referenced 316*a* and 316*b* respectively. The two rows are positioned on opposite sides of the longitudinal axis X—X of the housing 310. The upper cavities 316*a* are three in number and the lower cavities 316*b* are two in number. The housing 310 has, between its faces 312 and 314, an intermediate face 318 from which extend two arrays of cantilever latching lances 320 each of which projects into a respective cavity 316 longitudinally thereof, the lances in the cavities 316*a* being referenced 320*x* and those in the cavities 316*b* being referenced 320*y*. Between the faces 312 and 318, each cavity 316 is in the form of an open channel 322, each lance 320 having a latching nose 326, protruding thereinto and having a concave apex, each lance 320 having a free forward end 323. Each channel 322 is defined by a substantially semi-circular wall 327, each cavity 316 being defined by a wall 330 extending from the wall 327 to the face 314, providing a rear tubular portion 324 of the cavity 316. The wall 327 terminates at the face 312 in an inwardly directed semi-circular lip 328. The walls 327, lances 320 and the lips 328 of the cavities 316*a*, are oppositely orientated with respect to those of the cavities 316*b*.

The housing 310, has projecting beyond the face 312 thereof a hood 331 formed on each side thereof with a pair of lateral internal keyways 332 and 334, and with first and second rectangular, through, latching apertures 336 and 338 respectively, spaced from each other longitudinally of the housing 310. The hood 331 has a rear part 340 defining in cooperation with the forward part of the housing 310, a peripheral recess 342 for receiving a terminal locking, insulating, insert which is described below. The upper face of the part 340 is formed with an inspection opening 344. The forward part 346 of the hood 331 has a portion 348 projecting above said rear part 340 and defining a slide way 350 extending longitudinally of the hood 331, for receiving a latch arm on a mating housing which is described below. The portion 348 has formed, in its upper wall, a longitudinal slot 352 defining a forward latching shoulder 354, the slideway 350 terminating at its rear end in a stop shoulder 356.

The terminal locking insert which is generally referenced 358, will now be described with reference to FIGS. 42 to 48. The insert 358 comprises a planar body 360 of small thickness, having a leading face 362 and a trailing face 364, a hood 366 projecting from the outer periphery of the body 360, normally of the face 362 and completely surrounding the body 360. Side walls of the hood 366 define external lateral keys 368 and 370 which are complementary with the keyways 332 and 334, respectively, of the hood 331 and extend from the body 360 to the leading end 371 of the hood 366. Each key 370 has thereon, a latching stud 372 near the body 360, the studs 372 projecting from opposite sides thereof. A terminal locking bar 374 formed integrally with the body 360 and the hood 366, spans the latter, approximately midway between the upper and lower walls 376 and 378, respectively, of the hood 366. The wall 376 which is substantially longer than the wall 378, is formed with a central notch 380 having a chamfered base 382 for engaging a shoulder 343 at the rear end of the recess 342.

The bar 374 is of corrugated form so as to define an upper and a lower array of open channels 384, those of the upper array, which are three in number, being referenced 384*a* and those of the lower array which are two in number, being referenced 384*b*. Each channel 384 extends from the body 360 and opens into the leading end 386 of the bar 374. As will best be apparent from FIG. 43, the floor of each channel 384, which provides a latching lance support surface 388, deepens stepwise towards the leading end 386. In alignment with each channel 384, the body 360 is formed with a through circular opening 390, partially encircled by a collar 392 projecting from the face 362.

Each cavity 316 is shaped and dimensioned to receive an electrical pin terminal 394 (FIG. 52) comprising a crimping ferrule 396 crimped to an electrical lead L and an electrical pin 398 connected to the ferrule 396 by way of a waisted transition portion 400 defining a rearwardly facing latching shoulder 402 in cooperation with a collar 403 on the rear end of the pin 398.

The terminal locking insert 358 is assembled, as shown in FIG. 49, to the housing 310 into a terminal insertion position therein, by inserting the leading end 371 of the hood 366 into the forward extremity of the recess 342 of the housing 310 guided by the cooperation of the keys 368 and 370 of the hood 366 of the insert 358 and the keyways 332 and 334, respectively, of the hood 331 of the housing 310, until the latching studs 372 of the insert 358 latchingly engage in the first through apertures 336 of the hood 331 so that the insert 358 is latched in its terminal insertion position in which its bar 374 lies just forwardly of the leading ends 323 of the lances 320 leaving them free to flex. It can be checked that the insert 358 is in its terminal insertion position by observing that the studs 372 are indeed in the apertures 336.

A terminal 394 is now inserted into each cavity 320 by way of the terminal receiving face 314 of the housing 310, with the pin 398 leading, so that the collar 403 of each terminal 394 the rear inclined cam follower face 399 of the respective latching nose 326 in the cavity 320 to deflect the nose 326 downwardly in the case of the lances 320*x* and upwardly in the case of the lances 320*y*. Upon full insertion of each terminal into its cavity, the respective lance 320 resiles so that its nose 326 overlaps the shoulder 402 of the terminal 394 so that it is latched to its cavity with its pin 398 projecting through a respective opening 390 in the body 360 of the insert 358, the pin 398 having been guided through the opening 390 by the respective collar 392.

Figure 52:
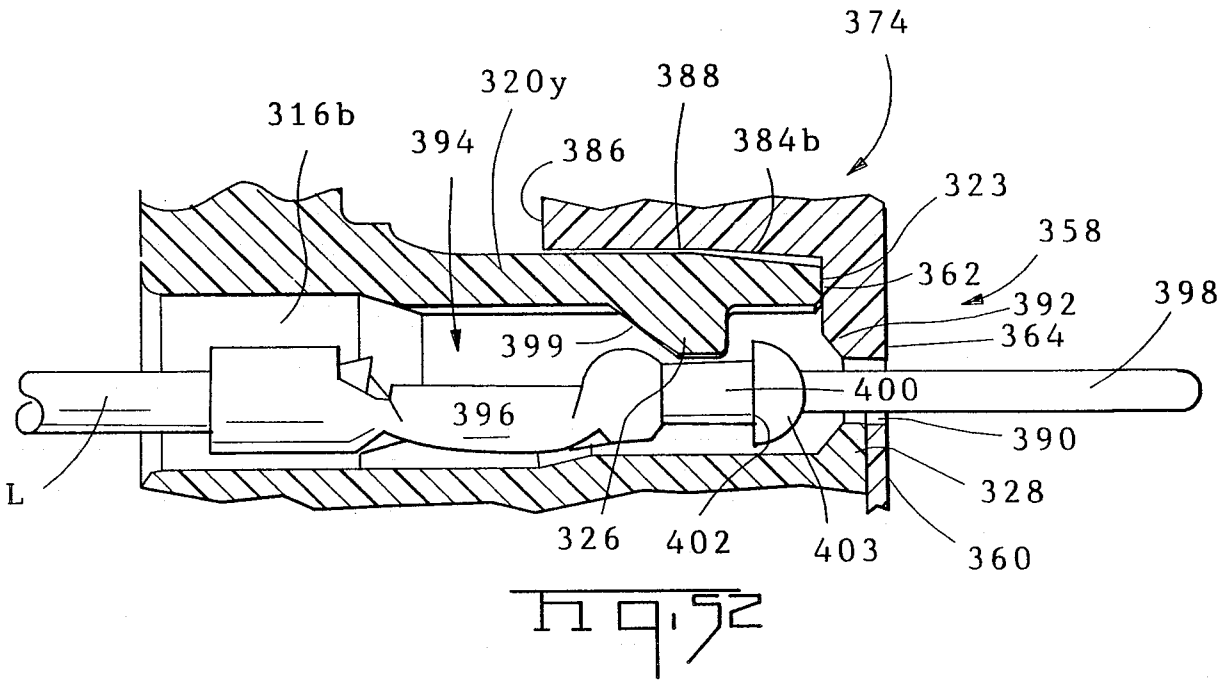
FIG. 52 is an enlarged, fragmentary, sectional view illustrating a cavity of the housing of the second embodiment, showing an electrical pin terminal in the cavity and the terminal locking insert, in fragmentary form, in a terminal locking position.
Figure 57:
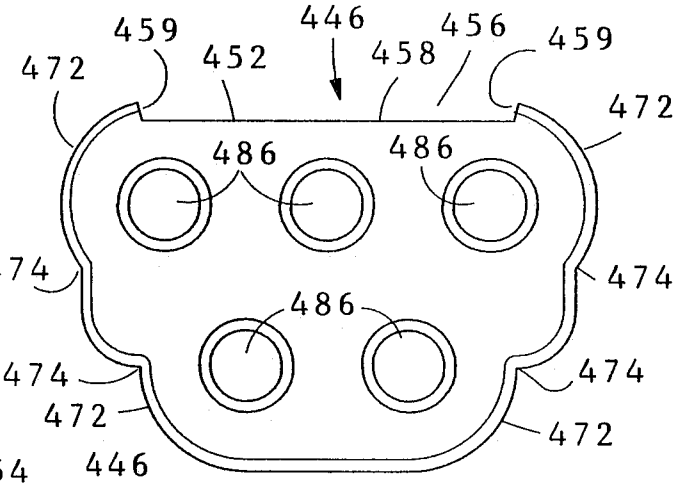
FIG. 57 is an enlarged front view of the terminal locking insert for the housing of FIGS. 53 to 56.
Figure 58:
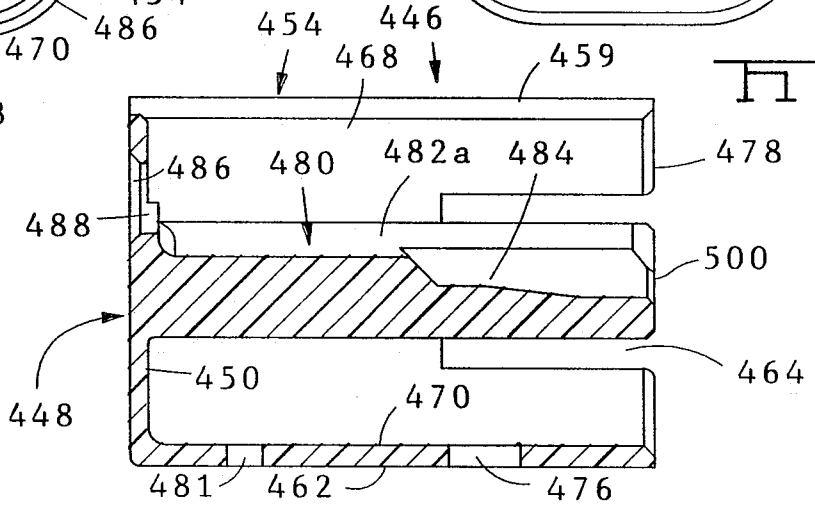
FIG. 58 is a view taken on the lines 58—58 of FIG. 57.
Figure 59:
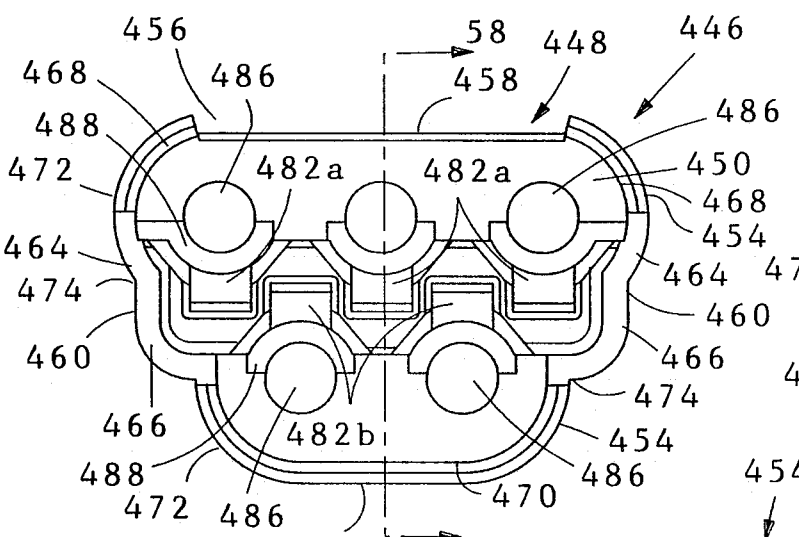
FIG. 59 is an enlarged rear view of the terminal locking insert of FIGS. 57 and 58.
Figure 165:
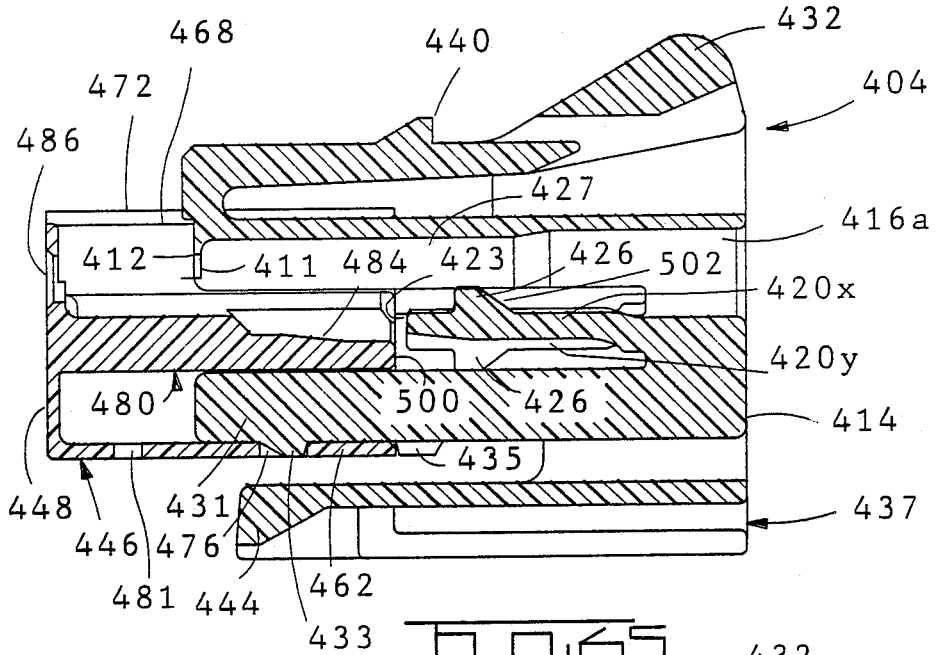
Figure 164:
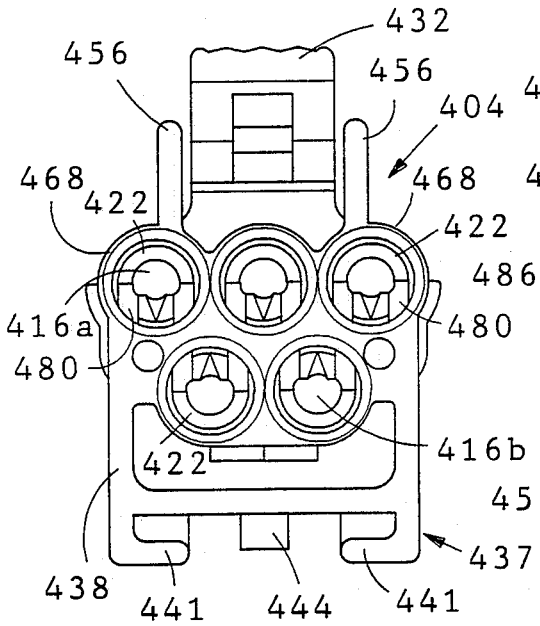
Figure 166:
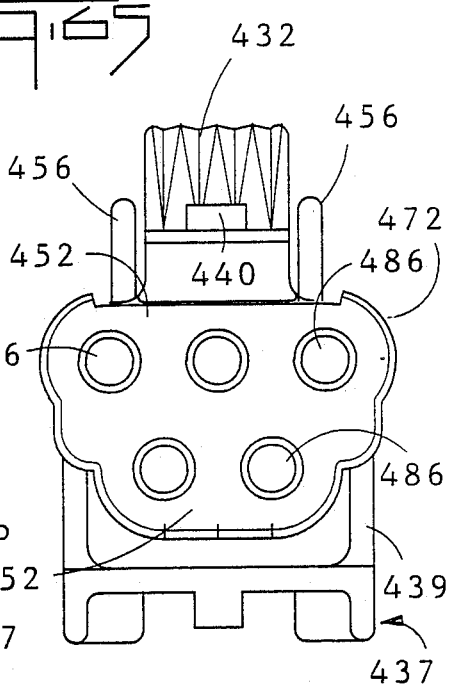
Figure 7:
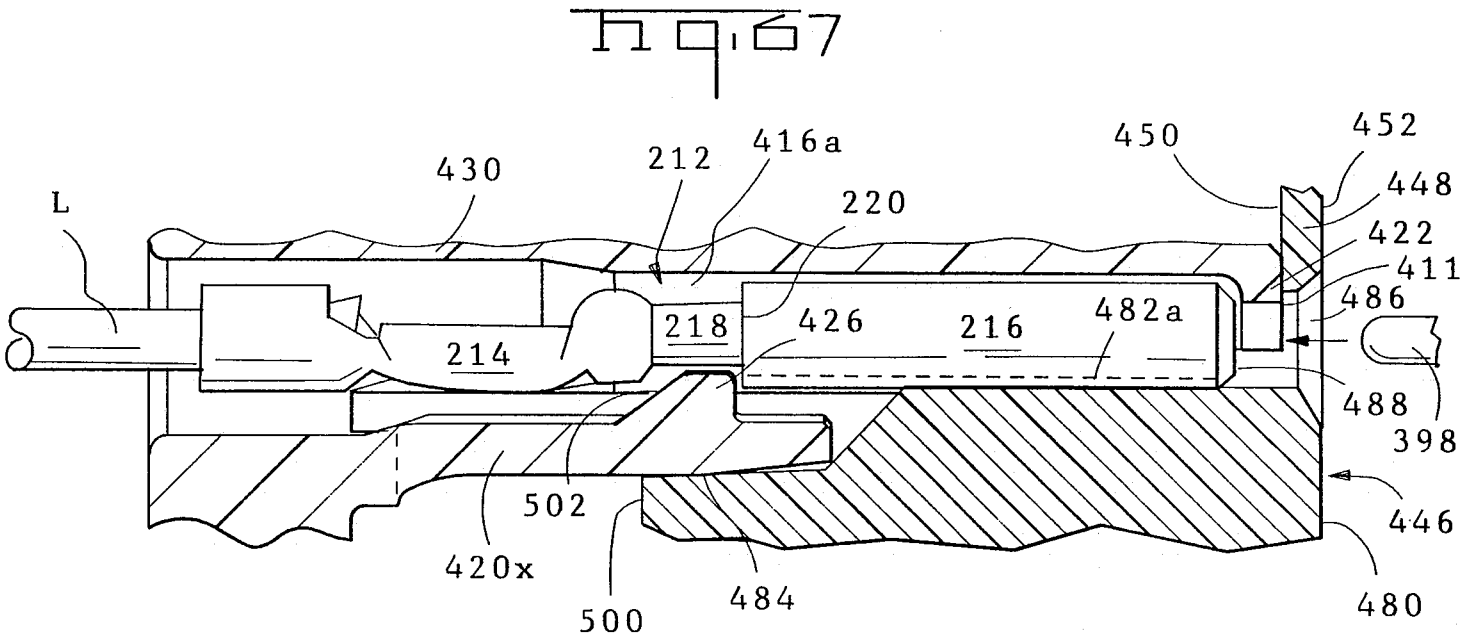

When the housing 310 has been fully loaded with terminals 394, the terminal locking insert 358 is pushed home into the recess 342 so that the leading end 371 of the hood 366 engages the shoulder 343, as the latching studs 372 latchingly engage in the respective second apertures 338 in the hood 331 of the housing 310, whereby the insert 358 is latched in its terminal locking position in which the support surfaces 388 of the bar 374 each support a respective lance 320 with its nose 326 in overlapping relationship with the respective shoulder 402 as shown in FIG. 52. The mating face 312 of the housing 310 is now fully covered by the body 360 of the insert 358, one of the pins 398 projecting into the hood 331 of the housing 310, from the face 364 of the body 360.

The terminal locking position of the insert 358 can be checked, by inspection of the hood 366 through the inspection opening 344. The insert 358 can, if need be, be withdrawn from its terminal locking position by inserting a tool blade (not shown) through the opening 334 to engage the base 382 of the notch 380.

In the terminal locking position of the insert 358, each open channel 384 cooperates with a respective open channel 322 to define an open ended tube enclosing the forward part of the terminal 394 in the channel 322.

A housing according to the fourth embodiment, for mating with the housing 310 of the second embodiment will now be described with reference to FIGS. 53 to 67. As best seen in FIGS. 53 to 56, an electrical connector housing 404 has a mating face 412 and a terminal receiving face 414 opposite thereto and defines two parallel, spaced, rows of terminal receiving cavities 416, the cavities of each row being referenced 416*a* and 416*b*, respectively, one row being positioned on each side of the longitudinal axis X—X of the housing 404, the cavities 416*a* being three in number and the cavities 416*b* being two in number. The housing 404 has, between its faces 312 and 314, an intermediate face 418 from which extend two arrays of terminal latching lances 420 each of which projects into a respective cavity 416 longitudinally thereof, the lances in the cavities 416*a* being referenced 420*x* and those in the cavities 416*b* being referenced 420*y*. Between the faces 412 and 418, each cavity 416 is in the form of an open channel 422, each lance 420 having a latching nose 426 protruding into the channel 422 and having a concave apex and a free forward end 423.

Each channel 422 is defined by a substantially semi-circular wall 427, the rear portion 424 of each cavity 416 being defined by a circular wall 430 extending from the wall 427, so that said rear portion 424 is tubular. At the mating face 412 each channel 422 terminates in a semi-circular inwardly projecting lip 411. The walls 427 and 430 of the cavities 416*a* are surmounted by a latch arm 432 connected to the forward end of the housing 404 by a resilient bight 434 and extending rearwardly thereof as a cantilever terminating in a raised handle 436 having finger grips 438, a latching projection 440 being positioned generally centrally of the handle 436 for engaging the latching shoulder 354 of the housing 310. The latch arm 432 is protected by a pair of plates 456 upstanding from the wall 427. In order to enable the production of the projection 440 by means of a straight action core pin the handle 436 has a through opening 457 in line with the projection 440. The channels 422 of the cavities 416*b* are defined by a lower wall 431 of the housing 404, having on its smoothly convex underside, two laterally and longitudinally offset latching studs 433 and 435, the stud 433 being nearer to the mating face 412 than the stud 435.

There depends from the wall 430 a foot 437 connected thereto by a side wall portion 439 and from which in turn depend a pair of opposed, longitudinal L-shaped rails 441 which are closed at their forward ends 443. At the forward end of the foot 437, a latching stud 444 depends therefrom midway between rails 440. The rails 441 and the stud 444 are for securing the housing 404 to a base (not shown). The walls 427 of the two outermost cavities 416*a* define arcuate opposed keys 443.

A terminal locking insert 446 for the housing 404 will now be described with reference to FIGS. 57 to 63. The insert 446 comprises a planar body 448 of small thickness, having a leading face 450 and a trailing face 452. A hood 454 projecting normally from the face 450 of the body 448 has an upper opening 456 extending substantially across the full width of the upper edge 458 of the body 448 and defines on opposite sides thereof a longitudinal rail 459. The hood 454 thus comprises a pair of opposed side walls 460 and a bottom wall 462. Each wall 460 is formed with a pair of opposed slots 464 each having a base 466. The upper part of each side wall 460 bounding the respective slot 464 is shaped to provide an internal arcuate keyway 468, the bottom wall 462 defining an internal keyway 470. The outer surfaces of the body 448 and side walls 460 define external longitudinal keys 472 and keyways 474, for mating with complementary internal keyways 332 of the hood 331 of the housing 310. The bottom wall 462 is formed with a longer and wider latching slot 476 nearest to the leading end 478 of the hood 454 and with a shorter and narrower laterally central latching slot 481 nearest to the body 448.

Figures 42, 43, 44, 45, 46, 47, 48:
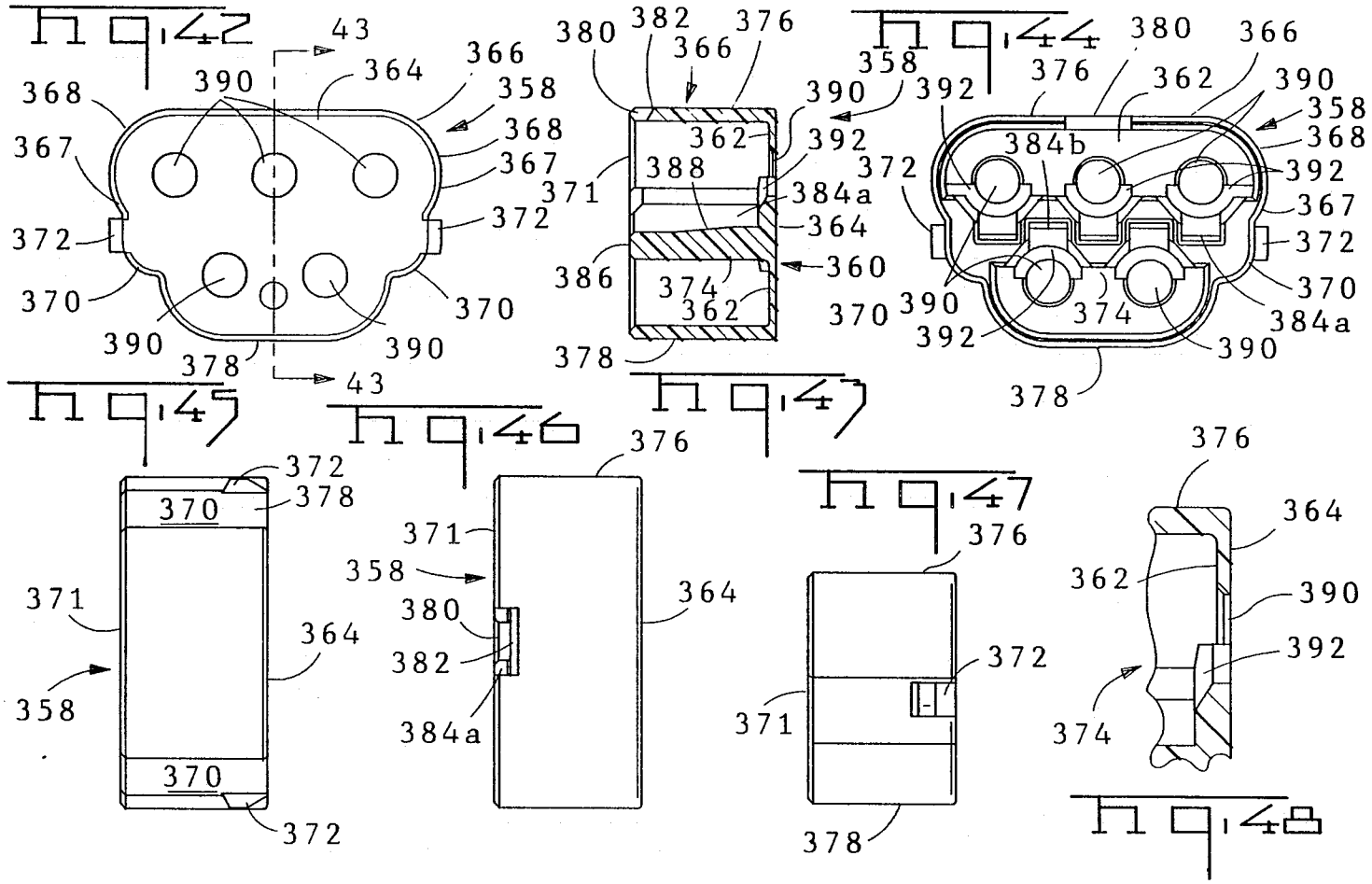
FIG. 42 is an enlarged rear view of a terminal locking insert for the housing of FIGS. 37 to 41.
FIG. 43 is a view taken on the lines 43—43 of FIG. 42.
FIGS. 44 to 47 are a front view, an under plan view, a top plan view and a side view of the terminal locking insert of FIGS. 42 and 43.
FIG. 48 is an enlarged fragmentary view illustrating details of FIG. 43.
Figures 47, 50, 51:
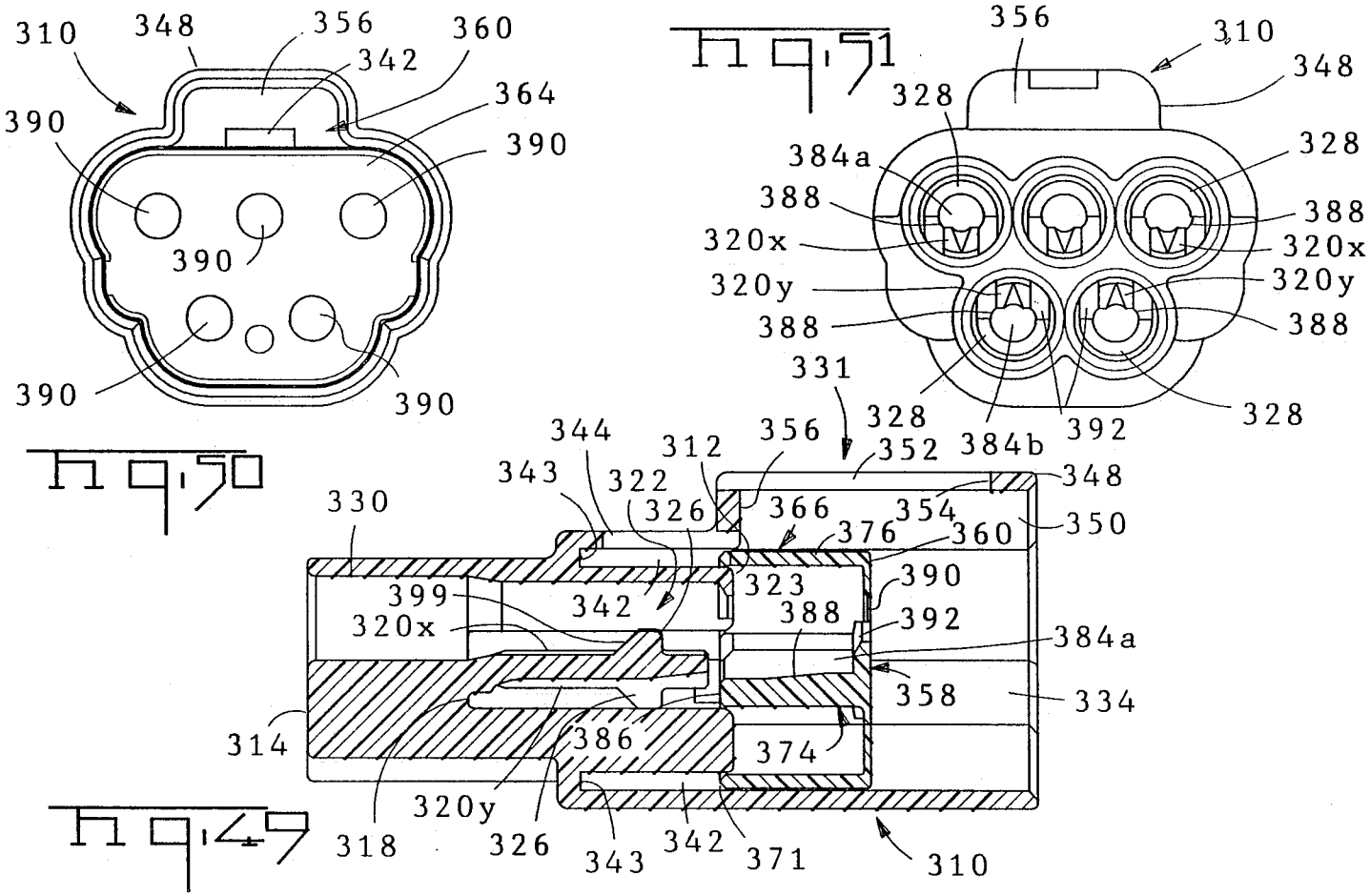
FIGS. 50 and 51 are a front view and a rear view respectively, of the housing as shown in FIG. 49.

A terminal locking bar 480 formed integrally with the body 448 and with the hood 454 spans the latter behind the slot 464 and projects forwardly there into. The bar 480 is of corrugated form so as to define an upper and a lower array of open channels 482, those of the upper row being referenced 482*a* of the lower row in reference 482*b*. Each channel 482 extends from the body 448 and opens into the leading end 478 of the hood 454. As best seen in FIGS. 41 and 45, the channel 482 deepens stepwise towards the leading end 478, from a position approximately half-way between the body 448 and the end 478, the deepened part of the channel 482 having a latching lance supporting floor 484. In alignment with each channel 482, the body 448 is formed with a circular through opening 486 partly surrounded by an internal collar 488.

Each cavity 416 is shaped and dimensioned to receive an electrical socket terminal 212 as described above with reference to FIG. 36.

Before loading the housing 404 with terminals 212, the insert 446 is assembled to the housing 404 by inserting the leading end 478 of the hood 454 into the housing 404 by way of its mating face 412 so that the internal keyways 468 of the insert 446 slideably receive the respective complementary keys 443 of the housing 404, the bar 480 sliding between the walls 427 and 431 of the housing 404 and the bottom wall 462 of the insert 446 sliding over the complementarily shaped arcuate external surface of the wall 431 until the stud 433 thereof latchingly engages the slot 476 of the bottom wall 462, as shown in FIG. 48 so that the insert 446 is latched in a terminal insertion position in the housing 404. In this position, a free-leading end 500 of the bar 480 is spaced just forwardly of the free-forward ends 423 of the lances 420, which thus remain free to flex.

A terminal 212 is now inserted into each cavity 416 from the mating face 412 of the housing 404, with the socket 216 of the terminal leading, so that it engages the rearwardly-inclined cam follower face 502 of the respective latching nose 426 in the cavity 416 to deflect it outwardly thereof. Upon full insertion of each terminal 212 into its cavity 416, the lance 420 resiles so that the nose 426 thereof overlaps the shoulder 220 of the terminal 212 so that it is latched into position into its cavity 416.

When the housing 404 has been fully loaded with terminals 212, the locking insert 446 is pushed home into the housing 404 so that the latching stud 433 is displaced from the slot 476 and slides along the inner surface of the wall 462 of the insert 446, which flexes resiliently outwardly to allow of this, until the stud 433 engages in the slot 481 and the stud 435 engages in the slot 476 of the wall 462, so that the insert 446 is thereby secured in its terminal locking position in the housing 404. In this position, as shown in FIG. 67, the free-end 500 of the bar 480 lies rearwardly of the nose 426 of the respective lance 420 so that the forward part thereof is supported by the floor 484 of the deepened part of the respective channel 482 whereby the lance is locked with its nose 426 overlapping the respective shoulder 220. The terminal can, therefore, under no circumstances, back out from its cavity. In said terminal locking position, each channel 482*a* cooperates with the respective channel 427 of a respective cavity 416*a*, each channel 482*b* cooperating with the channel 427 of a respective cavity 416*b*, to define an open ended tube enclosing the forward part of the respective terminal 212. Each collar 488 cooperates with a respective lip 411 to define an opening for receiving a pin 398 of a terminal in the housing 310.

In order to mate the connectors so provided by the housings 310 and 404 with respective terminals 394 and 212 loaded thereinto, as described above, and with the respective terminal locking inserts 358 and 446 in their terminal locking positions, the housing 404 is inserted into the housing 310 with the face 452 of the insert of the 446 leading, so that the bight 434 of the latch arm 432 enters the slideway 350 in the hood 331 of the housing 310 until the latching proJection 440 of the arm 432 latches behind the latching shoulder 354, the insert 446 being guided into the hood 331 by sliding cooperation between the respective keys 472 of the insert 446 and key-ways 332 of the housing 310, so that each pin 398 which projects from the body 360 of the insert 358 enters a respective socket 216 of a terminal in the housing 404, by way of a respective opening 486 the body 448 of the insert 446.

In the case of the second and third embodiments, as in the case of the first, the side walls of the deepened portions of the channels in the locking bars of the terminal locking inserts, serve to prevent lateral flexure of the latching lances, in the terminal locking positions of said inserts.

Particular advantages of a housing constructed in the manner described in any of the above embodiments, are that the housing, and especially the latching lances thereof can readily be molded by the use of straight action core pins, cross coring being unnecessary, and that the insert can be secured in a partially inserted position to allow the terminals to be loaded into the housing so that the insert need not be supplied separately to the customer, with the risk of loss of the insert or damage to its latch arms.

We claim:

1. An electrical connector housing assembly comprising an insulating housing having a terminal receiving rear face, a front face opposite thereto, a first array of terminal receiving first through cavities, each cavity opening into both of said front and rear faces, and a terminal locking, insulating insert for locking an electrical terminal in each cavity; characterized in that each cavity is provided with a terminal latching lance formed integrally with the housing and extending longitudinally of the cavities, the housing having an intermediate face between the front and rear faces and from which said latching lances extend, the length of each cavity between the front face and the intermediate face being in the form of a first array of first open channels; and in that said insulating insert has a first array of second open channels each of which is complementary with a respective first open channel, said insert being insertable into the housing so that each first open channel cooperates with a second open channel to define an open ended passageway.

2. The electrical connector of claim 1 characterized in that the connector includes a second array of terminal receiving through cavities spaced from those of the first array of through cavities, where the second cavities have a second array of first open channels, and the insulating insert has a second array of second open channels which are complementary with the open channels of the second array of cavities, and in that the cavities are provided with latching lances integrally formed with the housing.

3. The electrical connector of claim 2 characterized in that the open channels of the first cavities open towards the channels of the second cavities and vice versa, and the length of each cavity between said rear face and said intermediate face is tubular.

4. The electrical connector of claim 2 characterized in that the first and second array of through cavities are arranged in concentric circles.

5. An assembly according to claim 1, characterized in that said insert of said housing has latching members which are interengagable releasably to secure said insert initially in a partially inserted position in the housing to allow electrical terminals to be inserted into the said cavities by way of said rear face, and to finally secure said insert in a fully inserted position in the housing, in which position said insert maintains said latching lances in locking relationship with the terminals in the cavities.

6. An assembly according to claim 5, characterized in that the latching members comprise latch arms projecting from the insulating insert for reception in first and second sockets opening into said intermediate face, and first latching shoulders in said sockets which shoulders are proximate to said intermediate face and second latching shoulders in said sockets which are remote from said intermediate face.

7. An assembly according to claim 6, characterized in that each first latching shoulder is formed in a first socket and each second latching shoulder is formed in a second socket.

8. An assembly according to claim 6, characterized in that each latch arm has a bifurcated leading end portion for resiliently engaging opposite walls of the respective socket or, one leg of said end portion being formed with latching shoulder for latching engagement against a respective one of said first and second latching shoulders.

9. An assembly according to claim 6, characterized in that portions of the sockets project from said rear face of the housing; and in that the insulating insert is formed with openings for receiving tool blades for disengaging said latching members from said latching shoulders.

10. An assembly according to claim 1, characterized in that the first open channels of the second cavities are defined by longitudinal grooves in a post projecting into the housing from said intermediate face centrally thereof.

11. An assembly according to claim 1, characterized in that the housing is formed with an external peripheral collar and external latches for securing the housing in an opening in a panel with said rear face of the housing on one side of the panel and a hood projecting from the front face of the housing on the other side of the panel for receiving a mating electrical connector housing, said hood being externally screw threaded to mesh with screw thread engaging means in a coupling ring surrounding the mating connector housing.

12. An assembly according to claim 1, characterized in that the housing is formed with an external peripheral collar and external latches for securing the housing in an opening in a panel with said rear face of the housing on one side of the panel and a hood projecting from the front face of the housing on the other side of the panel for receiving a mating electrical connector housing, said hood being externally screw threaded to mesh with screw thread engaging means in a coupling ring surrounding the mating connector housing.

13. An assembly according to claim 1, characterized in that the housing is formed with an external peripheral collar, proximate to the rear face of the housing and against which is lodged a first sealing ring, the housing being surrounded by coupling ring and the sealing ring engaging the internal periphery of the coupling ring in sealing tight fashion, the coupling ring having internal projections for meshing with a screw thread in a mating connector housing and having an external peripheral sealing ring surrounding the front face of the housing and having a flat surface facing away therefrom.

14. An assembly according to claim 2, characterized in that said insert is insertable into the housing so that each first open channel cooperates with a second open channel to define an open ended tube, the cavities of each array thereof and the second open channels of each array thereof being arranged in a row and the terminal locking insert having at least one terminal locking bar insertable between the rows of first open channels to support the latching lances to lock the terminals in their cavities.

15. An assembly according to claim 14, characterized in that the terminal locking insert comprises a planar body from which extends normally thereof, said at least one terminal locking bar, which is corrugated so that opposite faces of the locking bar define said second open channels, which are dimensioned laterally to confine said lances, the planar body being formed with a through opening in alignment with each second open channel.

16. An assembly according to claim 15, characterized in that said cavities are arranged in pairs of arrays of cavities, the latching lances and the first open channels of the cavities of each pair of arrays thereof, being oppositely oriented, the terminal locking insert having a plurality of terminal locking bars each for insertion between the cavities of a respective pair of arrays thereof.

17. An assembly according to claim 15, characterized in that there projects from each of two opposite edges of said planar body a cantilever latch arm terminating in a transverse latching rib, the housing having oppositely positioned sockets proximate to its periphery, each for receiving a respective latch arm, each socket having therein spaced latching studs for cooperation with said latching rib to secure said insert initially in a partially inserted position in the housing to allow the terminals to be inserted into the cavities, by way of said rear face, and finally to secure said insert in a fully inserted position in the housing, in which position the insert maintains said latching lances in locking relationships with the terminals.

18. An assembly according to claim 17, characterized in that each latch arm has an outer face formed with a longitudinal groove terminating in said latching rib and an inner face formed with pads for resiliently engaging outer walls of the cavities.

19. An assembly according to claim 15, characterized in that said planar body is formed with peripheral keys and keyways for cooperation with complementary keyways and keys in the housing.

20. An assembly according to claim 14, characterized in that the terminal locking insert comprises a hood projecting from the outer periphery of the planar body normally thereof, and surrounding said locking bar which spans said hood, said hood having thereon an external latching stud, said housing defining an internal recess extending from, and about, the front face of the housing, for receiving the hood and having spaced openings therein for cooperation with said latching stud to latch said insert in terminal insertion, and terminal locking, positions in said housing.

21. An assembly according to claim 20, characterized in that said openings are formed in a hood of the housing, extending forwardly of the front face of the housing and being formed with internal keyways for cooperation with external keys on the hood of the insert, to guide the insert into the hood of the housing with a free end of the locking bar leading, until said planar body is proximate to the front face of the housing.

22. An assembly according to claim 20, characterized in that the hood of the housing defines a longitudinal slideway for a latch arm on a mating housing, a wall of the slideway having a longitudinal slot therein, defining a latching shoulder for engagement by a latching projection on the latch arm.

23. An assembly according to claim 15, characterized in that the terminal locking insert comprises a hood projecting from the outer periphery of the planar body, normally thereof, and into which hood said locking bar projects, said hood having a resiliently deformable first wall defining in cooperation with said locking bar a recess for receiving a second wall of said housing, said first and second walls having cooperating latch means for latching said insert initially in a terminal insertion position, and then in a terminal locking position, in a said housing.

24. An assembly according to claim 23, characterized in that the said planar body of said insert is formed with external keying means for guiding it into a hood of a mating housing, with said planar body leading.

25. An assembly according to claim 23, characterized in that a latch arm is connected to a first face of the housing by means of a bight and extending rearwardly of said insert, the latch arm having an operating handle proximate to the rear face of the housing and a latching projection between said bight and said handle.

* * * * *